US007218882B2

(12) United States Patent
Toba et al.

(10) Patent No.: US 7,218,882 B2
(45) Date of Patent: May 15, 2007

(54) DEVELOPING DEVICE, PROCESS CARTRIDGE, DEVELOPER LAYER REGULATING MEMBER, AND DEVELOPER LAYER REGULATING MEMBER ATTACHING METHOD

(75) Inventors: Shinjiro Toba, Shizuoka (JP); Masaaki Sato, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 95 days.

(21) Appl. No.: 10/957,610

(22) Filed: Oct. 5, 2004

(65) Prior Publication Data

US 2005/0254862 A1 Nov. 17, 2005

(30) Foreign Application Priority Data

May 14, 2004 (JP) ..... 2004-144839

(51) Int. Cl.
*G03G 15/08* (2006.01)

(52) U.S. Cl. ..... 399/284

(58) Field of Classification Search ..... 399/274, 399/284

See application file for complete search history.

(56) References Cited

U.S. PATENT DOCUMENTS

| | | | | |
|---|---|---|---|---|
| 4,378,753 | A * | 4/1983 | Ueno et al. | 399/274 X |
| 5,585,889 | A | 12/1996 | Shishido et al. | |
| 5,870,654 | A | 2/1999 | Sato et al. | 399/109 |
| 5,940,658 | A | 8/1999 | Yokoi et al. | 399/119 |
| 5,966,566 | A | 10/1999 | Odagawa et al. | 399/109 |
| 6,070,037 | A * | 5/2000 | Sugihara et al. | 399/274 |
| 6,104,894 | A | 8/2000 | Sato et al. | 399/106 |
| 6,131,007 | A | 10/2000 | Yamaguchi et al. | 399/256 |
| 6,188,856 | B1 | 2/2001 | Sato | 399/119 |
| 6,298,203 | B1 * | 10/2001 | Hashimoto et al. | 399/274 X |
| 6,334,038 | B1 * | 12/2001 | Kawahara | 399/274 |
| 6,381,420 | B1 | 4/2002 | Sato et al. | 399/27 |
| 6,519,431 | B1 | 2/2003 | Toba et al. | 399/111 |
| 6,542,706 | B2 | 4/2003 | Toba et al. | 399/111 |
| 6,549,736 | B2 | 4/2003 | Miyabe et al. | 399/111 |
| 6,603,939 | B1 | 8/2003 | Toba et al. | 399/103 |
| 6,714,749 | B2 | 3/2004 | Sato et al. | 399/102 |
| 6,795,672 | B2 * | 9/2004 | Yamamoto et al. | 399/284 |
| 6,937,835 | B2 * | 8/2005 | Okamoto | 399/284 |
| 2003/0228171 | A1 | 12/2003 | Miyabe et al. | 399/111 |

FOREIGN PATENT DOCUMENTS

| | | |
|---|---|---|
| JP | 9-171303 | 6/1997 |

* cited by examiner

*Primary Examiner*—Sandra L. Brase
(74) *Attorney, Agent, or Firm*—Fitzpatrick, Cella, Harper & Scinto

(57) ABSTRACT

A developing device for developing a latent image formed on an image bearing member by using developer, the developing device including: a developing frame; a developing roller for supplying developer to the latent image to develop the latent image; a developer layer regulating member which regulates a layer thickness of developer on a circumferential surface of the developing roller; and a first surface and a second surface which are provided in the developer layer regulating member along a longitudinal direction of the developer layer regulating member, for positioning the developer layer regulating member with respect to the developing frame, in which a first imaginary plane, which is obtained by extending the first surface imaginarily, and a second imaginary plane, which is obtained by extending the second surface imaginarily, intersect each other.

31 Claims, 13 Drawing Sheets

EMBODIMENT

COMPARATIVE EXAMPLE 1

COMPARATIVE EXAMPLE 2

EMBODIMENT 3

DEVELOPING DEVICE, PROCESS CARTRIDGE, DEVELOPER LAYER REGULATING MEMBER, AND DEVELOPER LAYER REGULATING MEMBER ATTACHING METHOD

BACKGROUND OF THE INVENTION

1. Field of the Invention

The present invention relates to a developing device, a process cartridge, a developer layer regulating member, and a developer layer regulating member attaching method.

2. Related Background Art

In electrophotographic image forming apparatuses such as a copying machine, a laser printer, and a facsimile machine, an electrostatic latent image is formed through selective exposure on an electrophotographic photosensitive drum that is uniformly charged by a charging device. Developer is deposited onto the thus formed electrostatic latent image by a developing device, thus developing the electrostatic latent image as a developer image. The developer image is then transferred to a recording medium, thus forming an image on the recording medium. Then, a cleaning device removes from the electrophotographic photosensitive drum any developer remaining on the surface after the transfer of the developer image, thus leaving the electrophotographic photosensitive drum ready for the next image forming process.

Conventionally, there has been adopted a process cartridge system in which an electrophotographic photosensitive drum and components acting on the electrophotographic photosensitive drum, such as charging means (charging device), developing means (developing device), and cleaning means (cleaning device), are integrated into a single cartridge that is detachably mounted to an electrophotographic image forming apparatus main body (hereinafter referred to as the "image forming apparatus main body"). The cartridge system realizes improved operability, allowing for easy maintenance on the above-described process means by the user himself. For this reason, the cartridge system is now widely adopted for an image forming apparatus main body.

In recent years, there has been increased demand for the miniaturization of an image forming apparatus main body. This also led to growing demand for the miniaturization of a process cartridge.

However, the sizes of components such as a developing roller that carries developer in a developing device, an electrophotographic photosensitive drum that is an image bearing member on which an electrostatic image is formed, etc., depend on the size of desired image formation, which inevitably puts a limit on the miniaturization of those components. This also puts a limit on the miniaturization of members acting on those components, for example, a developer layer regulating member that regulates the thickness of a developer layer on the circumferential surface of a developer roller.

Incidentally, of conventional developer layer regulating members, there is one in which, for example, a positioning portion and a fixing portion are arranged on the same plane as a mounting surface extending in the longitudinal direction parallel to a developing roller (JP H09-171303 A).

However, the regulation width in the longitudinal direction of the developer layer regulating member determines the developing width of the developer roller in accordance with the image formation region on the photosensitive drum. Therefore, there is a limit to the miniaturization of the developing roller.

Further, as to the positioning method for the developer layer regulating member, the surface where the fixation of the developer layer regulating member to the developing container is effected lies on the same plane as the plane parallel to the longitudinal direction of the developing roller. Moreover, a fitting portion for effecting positioning and a screw hole for effecting fixation are arranged in close proximity to each other in the lateral direction crossing the longitudinal direction of the developer layer regulating member. Therefore, there is a limit to achieving miniaturization of the developer layer regulating member through a reduction in the distance between the fitting portion and the screw hole by bringing them closer to each other.

SUMMARY OF THE INVENTION

It is an object of the present invention to provide a developer layer regulating member capable of achieving improved miniaturization, and a developing device and a process cartridge which are provided with the developer layer regulating member.

It is another object of the present invention to provide a developer layer regulating member capable of achieving enhanced ease of assembly, and a developing device and a process cartridge which are provided with the developer layer regulating member.

It is another object of the present invention to provide a developer layer regulating member capable of achieving improved miniaturization and enhanced ease of assembly, and a developing device and a process cartridge which are provided with the developer layer regulating member.

It is another object of the present invention to provide a developer layer regulating member attaching method capable of achieving enhanced ease of assembly.

It is another object of the present invention to provide a developer layer regulating member, a developing device, and a process cartridge, which have a first surface and a second surface that extend in the longitudinal direction of a developing roller and in which a first imaginary plane, which is obtained by extending the first surface in an imaginary dimension, and a second imaginary plane, which is obtained by extending the second surface in an imaginary dimension, cross each other.

It is another object of the present invention to provide a developer layer regulating member attaching method of attaching to a developing frame a developer layer regulating member which regulates a layer thickness of developer on a circumferential surface of a developing roller, the developer layer regulating member including: a first surface extending along a longitudinal direction of the developer layer regulating member and having a developer layer regulating portion for regulating the layer thickness; a second surface bent at a substantially perpendicular direction with respect to the first surface and extending along the longitudinal direction; and a groove portion provided in an end portion of the second surface on a side opposite to the first surface and formed in the substantially perpendicular direction, the developer layer regulating member attaching method including: fitting in the groove portion a projecting portion provided in the developing frame for determining a position in the longitudinal direction of the developer layer regulating member with respect to the developing frame; and abutting, with the projecting portion being fitted in the groove portion, a position regulating portion provided in the developing frame against the first surface by moving the developer layer regulating member in the substantially perpendicular direction for determining a position in the substantially perpendicular direction of the developer-layer regulating member with respect to the developing frame.

These and other objects, features and advantages of the present invention will become more apparent upon consideration of the following description of the preferred embodiments of the present invention taken in conjunction with the accompanying drawings.

DESCRIPTION OF THE PREFERRED EMBODIMENTS

Hereinbelow, embodiments of the present invention are described in detail with reference to the drawings.

Embodiment 1

(1) [General Overall Construction of Image Forming Apparatus]

Figure 1:
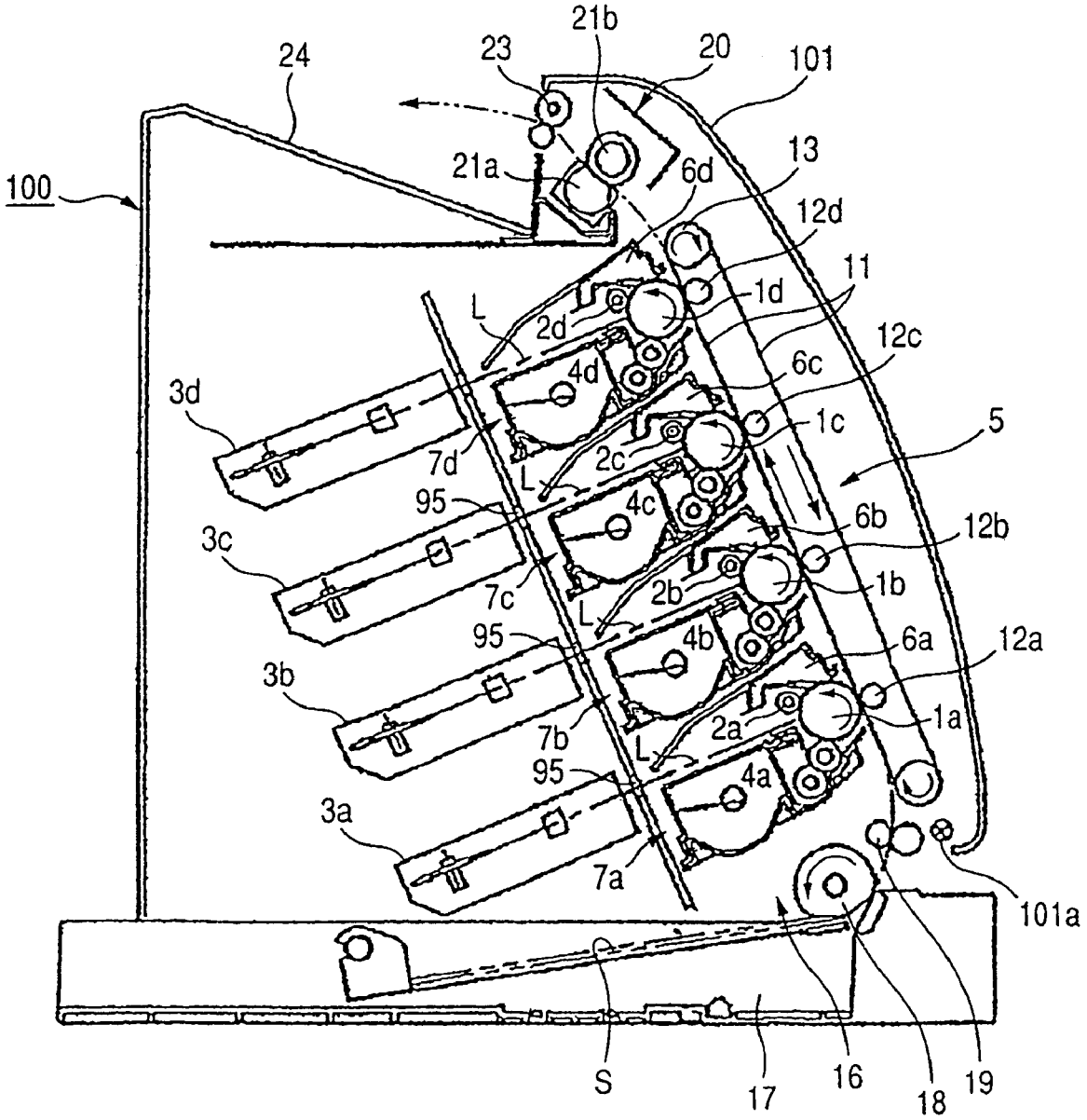
FIG. 1 is a longitudinal sectional view showing a general construction of an electrophotographic image forming apparatus.

FIG. 1 is a schematic cross-sectional view showing the general overall construction of a multi-color image forming apparatus according to Embodiment 1 of the present invention. The multi-color image forming apparatus is a full-color laser beam printer of a vertical-tandem type or a detachable process-cartridge type employing a transfer-type electrophotographic process.

Figure 2:
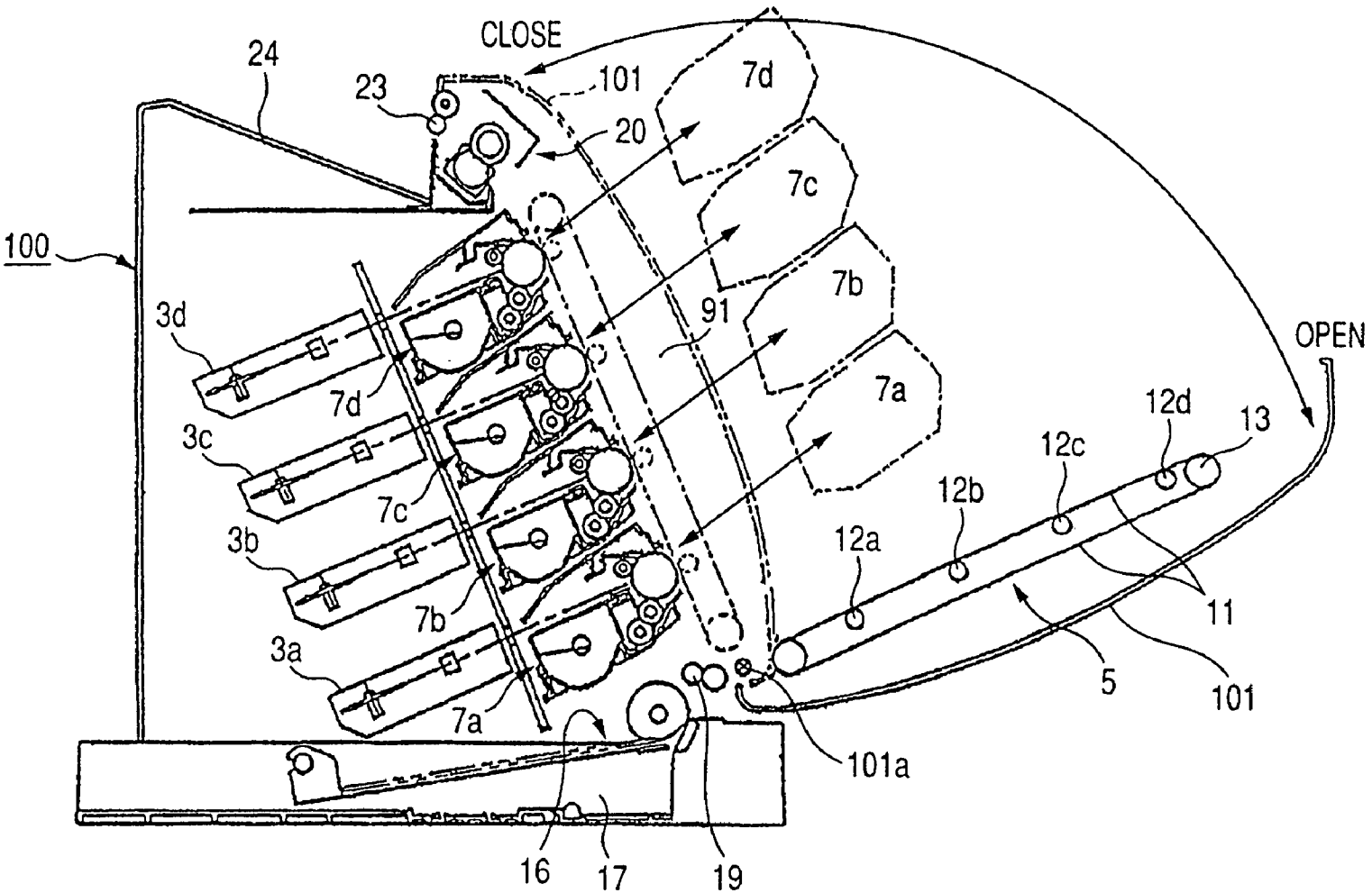
FIG. 2 is a longitudinal sectional view showing a state in which a front cover of the electrophotographic image forming apparatus is opened to expose a process cartridge insertion opening.

An image forming apparatus main body 100 (hereinafter referred to as the "apparatus main body") has an apparatus front cover (hereinafter referred to as the "front cover") 101. The front cover 101 is openable and closable relative to the front side portion of the apparatus main body 100 about a hinge shaft 101*a* on the bottom edge side thereof. FIG. 1 shows a state where the front cover 101 is closed with respect to the apparatus main body 100. FIG. 2 shows a state in which the front cover 101 is opened frontward to expose a process cartridge insertion opening 91 inside the apparatus main body.

Process cartridges (hereinafter referred to as the "cartridges") (7*a* to 7*d*) form developer images of magenta, cyan, yellow, and black colors corresponding to the color separation components of a full-color image, respectively. Those cartridges (7*a* to 7*d*) are arranged within the apparatus main body from bottom to top in order, obliquely with respect to the vertical direction.

Each of the cartridges (7*a* to 7*d*) includes a photosensitive drum 1 (1*a* to 1*d*) as an image bearing member. Further, each of the cartridges (7*a* to 7*d*) includes a charging device (charging means) 2 (2*a* to 2*d*) for uniformly charging the photosensitive drum surface. Further, each of the cartridges (7*a* to 7*d*) includes a developing device (developing means) 4 (4*a* to 4*d*) for depositing a one-component developer (hereinafter referred to as the "toner") onto an electrostatic latent image formed on the photosensitive drum to develop the electrostatic latent image as a toner image. Further, each of the cartridges (7*a* to 7*d*) includes a cleaning device (cleaning means) 6 (6*a* to 6*d*) for removing toner remaining on the photosensitive drum surface after transferring the toner image to a recording medium.

The developers received in the respective developing devices 4 (4*a* to 4*d*) of the first to fourth cartridges (7*a* to 7*d*) are a magenta toner, a cyan toner, a yellow toner, and a black toner, respectively.

Scanner units (3*a* to 3*d*) are provided in correspondence with the respective four cartridges (7*a* to 7*d*) mentioned above. Each scanner unit irradiates one of the photosensitive drums (1*a*–1*d*) with a laser beam (image light) L, forming an electrostatic image on the photosensitive drum 1. An electrostatic transfer device (electrostatic transfer means) 5 is arranged on the inner side of the front cover 101. The front cover 101, including the electrostatic transfer device 5, is opened and closed with respect to the apparatus main body 100 (FIG. 2). With the front cover 101 being closed in with respect to the apparatus main body 100 as shown in FIG. 1, the electrostatic transfer device 5 faces all of the respective photosensitive drums 1 (1*a* to 1*d*) of the first to fourth cartridges (7*a* to 7*d*). Transfer rollers (12*a* to 12*d*) are arranged side by side while in contact with the inner side of an electrostatic transfer belt 11, sandwiching the electrostatic transfer belt 11 between them and all of the respective photosensitive drums 1 (1*a* to 1*d*) of the first to fourth cartridges (7*a* to 7*d*).

A recording medium feeding portion 16 is arranged in a lower part of the apparatus main body 100. The feeding portion 16 feeds a recording medium S toward the electrostatic transfer belt 11 of the electrostatic transfer device 5. The feeding portion 16 includes a feed roller (semicircular roller) 18 and a registration roller pair 19.

A fixing portion 20 is arranged in an upper part of the apparatus main body 100. The fixing portion 20 effects fixing of toner images of multiple colors transferred to the image recording medium S. The fixing portion 20 includes a rotary heating roller 21*a*, a pressure roller 21*b* in press contact with the heating roller 21*a* to apply a pressure to the recording medium S, and the like. A discharge roller 23 delivers the recording medium S on which image formation has been effected toward a discharge tray portion 24 arranged on the top surface of the apparatus main body 100.

The respective photosensitive drums 1 (1*a* to 1*d*) of the four, that is, the first to fourth, cartridges (7*a* to 7*d*) rotate sequentially in the counter-clockwise direction in accordance with predetermined printing timings of an image formation sequence. Then, the scanner units (3*a* to 3*d*) corresponding to the respective cartridges (7*a* to 7*d*) are driven sequentially. Further, the electrostatic transfer belt 11 of the electrostatic transfer device 5 is driven to rotate in the clockwise direction by a driving roller 13 as indicated by the arrows.

As the photosensitive drums 1 (1*a* to 1*d*) rotate, they are uniformly charged by the charging devices 2 (2*a* to 2*d*) with a predetermined polarity (negative polarity in this embodiment) and a predetermined potential. Thereafter, by using a-laser beam L modulated in accordance with image information outputted from each of the scanner units (3*a* to 3*d*), an electrostatic latent image of the image information is formed on each of the photosensitive drums 1 (1*a* to 1*d*).

The electrostatic latent image thus formed is developed (through reversal development using a toner with negative polarity in this embodiment) by each of the developing devices 4 (4*a* to 4*d*) as a toner image. As a result, toner images of magenta, cyan, yellow, and black colors are formed on the surfaces of the respective photosensitive drums 1 (1*a* to 1*d*) at predetermined sequence control timings.

Meanwhile, the feed roller 18 of the feeding portion 16 rotates at a predetermined sequence control timing. As a result, the recording medium S within a cassette 17 is fed sheet by sheet. The recording medium S temporarily stops as its leading edge abuts a nip portion of the registration roller pair 19. The registration roller pair 19 then rotates while synchronizing with the rotation of the electrostatic transfer belt 11 and the writing positions of the respective toner images formed on the photosensitive drums 1 (1*a* to 1*d*). The recording medium S is thus fed toward the electrostatic transfer belt 11. Then, the recording medium S is stably retained in position as it is electrostatically attracted onto the electrostatic transfer belt surface naturally due to the static electricity with which the electrostatic transfer belt 11 is charged. Then, as the electrostatic transfer belt 11 moves, the recording medium S is conveyed to a transferring part.

Further, the recording medium S is conveyed from lower to upper parts as the electrostatic transfer belt 11 rotates. As the recording medium S is conveyed in this way, the toner images of magenta, cyan, yellow, and black colors formed on the respective surfaces of the photosensitive drums 1 (1*a* to 1*d*) are sequentially transferred to the recording medium S in a superimposed manner at the respective transferring parts of the photosensitive drums 1 (1*a* to 1*d*). The recording medium S, on which the toner images of four colors have been transferred in a superimposed manner, is subjected to curvature separation from the electrostatic transfer belt 11 due to the curvature of the electrostatic transfer belt driving roller 13, to be conveyed into the fixing portion 20. Then, the recording medium S is nipped and conveyed at a fixing nip portion formed by the rotary heating roller 21*a* and the pressure roller 21*b* in press contact with the heating roller 21*a*. Heat and pressure are thus applied to the recording medium S, and toner images of multiple colors are fixed onto the surface of the recording medium S. Thereafter, the recording medium S is discharged onto the discharge tray 24 outside the apparatus main body 100 by the discharge roller pair 23 with its image formation surface facing down.

Further, deposits, such as transfer residual toner remaining on the photosensitive drums 1 (1*a* to 1*d*) after the transfer of respective toner images to the recording medium S, are removed by the cleaning devices 6 (6*a* to 6*d*), leaving the photosensitive drums 1 (1*a* to 1*b*) ready for the next image formation cycle.

(2) [Process Cartridges (7*a*–7*d*)]

Figure 3:
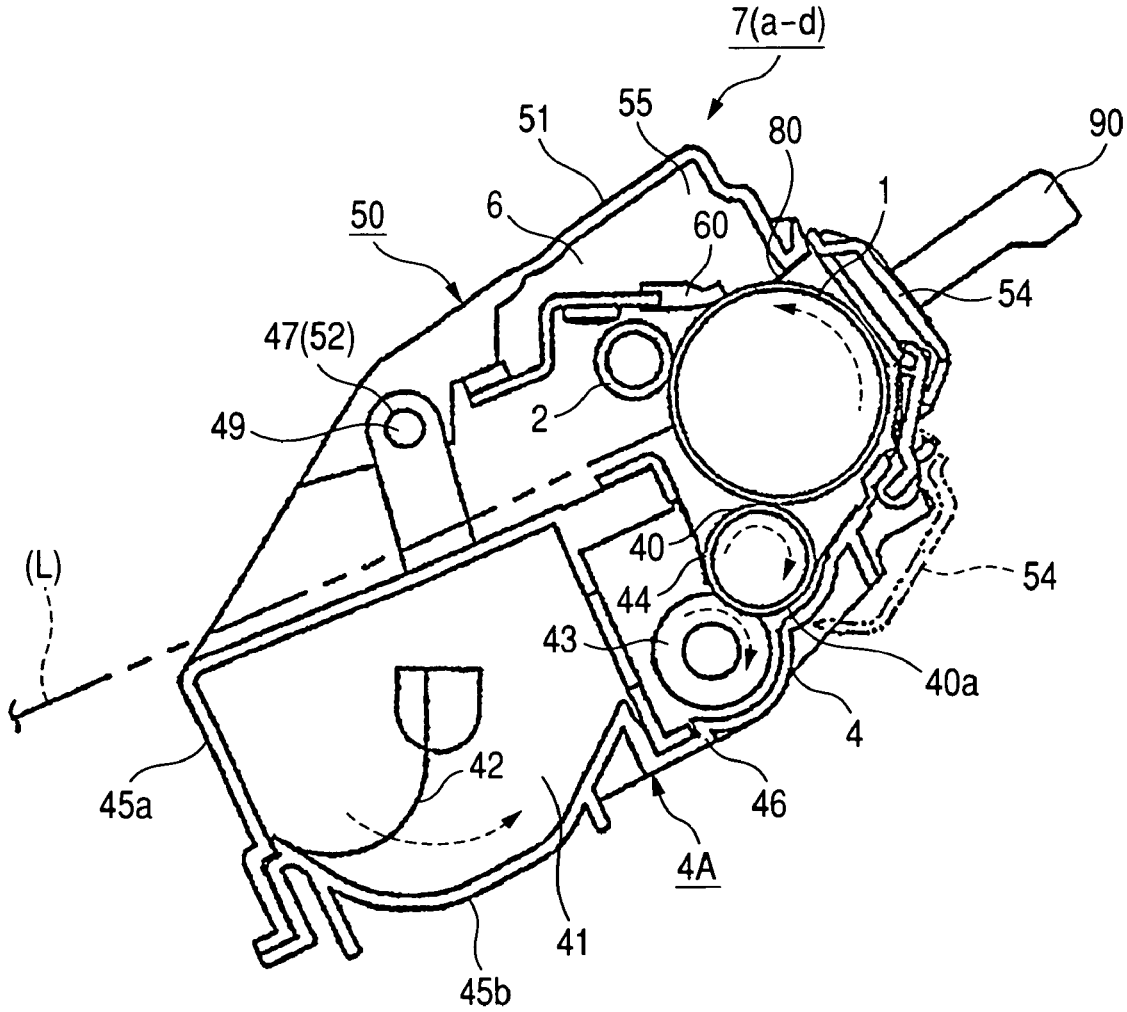
FIG. 3 is an enlarged cross sectional view of a process cartridge.
Figure 4:
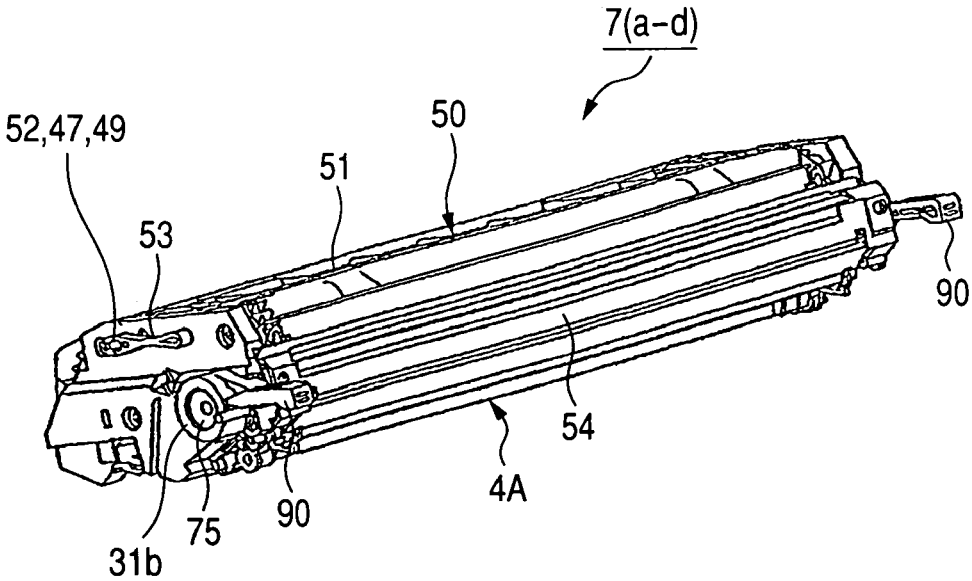
FIG. 4 is a perspective view for illustrating the process cartridge.
Figure 5:
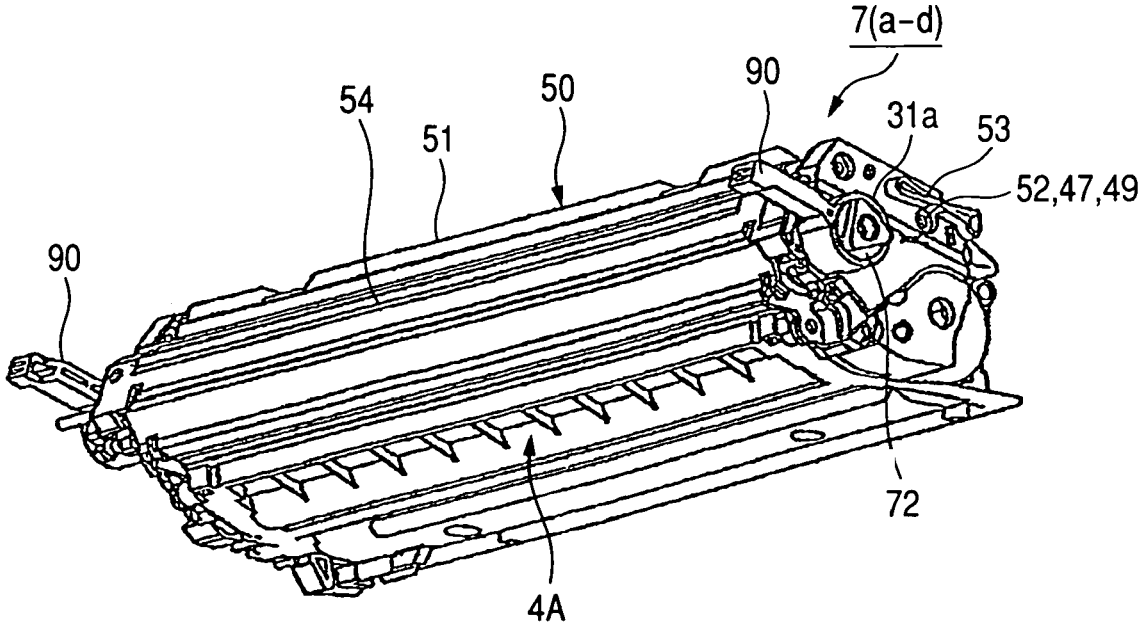
FIG. 5 is a perspective view for illustrating the process cartridge.

FIG. 3 is an enlarged cross sectional view of each cartridge 7, and FIGS. 4 and 5 are each a schematic perspective view of the cartridge 7.

In this embodiment, the photosensitive drum 1 is incorporated into the cartridge. Thus, the photosensitive drum 1 is mounted to and detached from the apparatus main body 100 through mounting and detachment of the cartridge to and from the apparatus main body 100.

Herein, in the following description, the lateral direction of the cartridge refers to the direction in which the cartridge is mounted to and detached from the apparatus main body 100. Further, the longitudinal direction of the cartridge refers to the direction that crosses the direction in which the cartridge is mounted to and detached from the apparatus main body 100. The front side of the cartridge refers to the side from which the opening portion through which the photosensitive drum is exposed is viewed in the direction in which the cartridge is mounted to and detached from the apparatus main body 100. Further, the back side of the cartridge refers to the opposite side of the cartridge as viewed from the front side thereof. Further, the right and left sides refer to the right-hand and left-hand sides of the cartridge as viewed from the front side thereof. Further, the upper surface of the cartridge refers to the surface located at an upper part with the cartridge being mounted to the apparatus main body 100. Further, the lower surface of the cartridge refers to the surface located at a lower part in this state.

The first to fourth cartridges (7*a* to 7*d*) are of the same construction except for the kinds of developers received in their respective toner container portions (developer receiving portions).

Each cartridge includes a cleaner unit 50 and a developing unit 4A. The cleaner unit 50 includes the photosensitive drum 1, and the charging device 2 and the cleaning device 6. Further, the developing unit 4A includes the developing device 4 for developing an electrostatic latent image on the photosensitive drum 1.

Flange members 72 and 75 are provided at both longitudinal end portions of the photosensitive drum 1. The flange members 72 and 75 are rotatably supported by support (bearing) members 31*a* and 31*b* provided in the right and left side surfaces of a cleaning frame 51, respectively. Of the above two flange members 72 and 75, the flange member 72 receives a drive force from a drive transmission member (not shown) provided on the apparatus main body 100 side. The photosensitive drum 1 is thus driven to rotate.

As the charging device 2, an electroconductive roller of a contact-charging type is used. The electroconductive roller rotates following the rotation of the photosensitive drum while in contact with the photosensitive drum surface. By applying a charging bias voltage to this roller at this time, the photosensitive drum surface is uniformly charged.

The residual toner (waste toner) removed from the photosensitive drum 1 surface by a cleaning blade 60 is received in a waste toner chamber (residual toner receiving portion) 55 provided above the cleaning blade 60. Further, the transfer residual toner on the photosensitive drum passes through a portion of a flexible sheet member 80 which is in contact with the photosensitive drum, to reach the position of the cleaning blade 60. Here, the flexible sheet member 80 serves to prevent the residual toner removed from the photosensitive drum surface by the cleaning blade 60 from leaking to the exterior of the cleaning frame 51.

In this embodiment, the developing unit 4A includes a developing sleeve (developing roller) 40, and developing frames 45*a* and 45*b* for receiving toner. Herein, the developing frames 45*a* and 45*b* may be any frames in which a developing blade 44 as a developer layer regulating member can be disposed. The developing sleeve 40 rotates in the clockwise direction as indicated by the arrow while maintaining a minute gap between the developing sleeve 40 and the photosensitive drum 1 by a spacer roller 40*a*. The developing frames 45*a* and 45*b* are joined together by ultrasonic welding or the like. The developing sleeve 40 is rotatably supported to a developer container unit 46 through the intermediation of a bearing member (not shown). Further, arranged in the periphery of the developing sleeve 40 are a toner supplying roller 43 that rotates in the clockwise direction as indicated by the arrow while in contact with the developing sleeve 40, and the developing blade (developer layer regulating member) 44. Further, provided inside a toner container portion (developer receiving portion) 41 is a toner conveying mechanism 42 for conveying toner to the toner supplying roller 43. A detailed description of the developing blade 44 is given in the section (4) [Developing Blade 44] later.

A connecting hole 47, which is provided at either longitudinal end of the developer container unit 46, and a support hole 52, which is provided in each of the right and left side surfaces of the cleaning frame 51 of the cleaner unit 50, are aligned with each other, and a pin 49 is inserted therethrough. The developing unit 4A is thus joined to the cleaner unit 50. The developing unit 4A is swingably supported to the cleaner unit 50. Further, the developing unit 4A is urged toward the cleaner unit 50 side by a pressure spring (not shown) so as to be pivotable about the pin 49. As a result, the spacer roller 40*a* of the developing sleeve 40 comes into contact with the photosensitive drum 1.

During the developing process, the toner supplying roller 43 rotating in the clockwise direction as indicated by the arrow frictionally slides on the developing sleeve 40 rotating in the clockwise direction as indicated by the arrow. The toner supplying roller 43 thus supplies toner onto the developing sleeve 40. The toner carried on the circumferential surface of the developing sleeve 40 is conveyed as the developing sleeve 40 rotates, reaching the position of the developing blade 44. Then, the amount of the toner is regulated by the developing blade 44, thus forming a predetermined thin toner layer, which is imparted with a desired quantity of electric charge. As the developing sleeve 40 rotates, the toner thus formed as a thin layer on the developing sleeve 40 is conveyed to a developing portion where the photosensitive drum 1 and the developing sleeve 40 are in close proximity to each other. At the developing portion, the toner formed as the thin layer adheres to an electrostatic latent image formed on the surface of the photosensitive drum 10 due to the developing bias applied to the developing sleeve 40 from a power source (not shown). The electrostatic latent image is thus developed.

The toner remaining on the surface of the developing sleeve 40 without positively contributing to the developing of the electrostatic latent image is returned into the developing device as the developing sleeve 40 rotates. Then, the residual toner is scraped off from the developing sleeve 40 at the portion where the developing sleeve 40 frictionally slides on the toner supplying roller 43, and the scraped toner is collected for recovery.

A shutter member 54 that protects the photosensitive drum 1 is provided to the cleaning frame 51. The shutter member 54 is openable and closable by an opening and closing mechanism (not shown) between a closed portion (FIGS. 3 to 5) where the shutter member 54 covers up the opening portion on the front side of the cartridge through which the photosensitive drum is exposed to the exterior, and an open position (indicated by the two-dot chain line of FIG. 3) where the shutter member 54 is shifted downward to a lower position from the opening portion through which the photosensitive drum is exposed to the exterior.

An insertion guide portion 90 is provided in each of the right and left side surfaces of the cleaning frame 51. The insertion guide portion 90 consists of a grip portion, which is gripped when mounting and detaching the cartridge to and from the apparatus main body 100. The insertion guide portion 90 protrudes toward the cartridge front side from each of the right and left side surfaces of the cleaning frame 51.

(3) [Method of Mounting and Detaching the Cartridges (7*a*–7*d*)]

Figure 6:
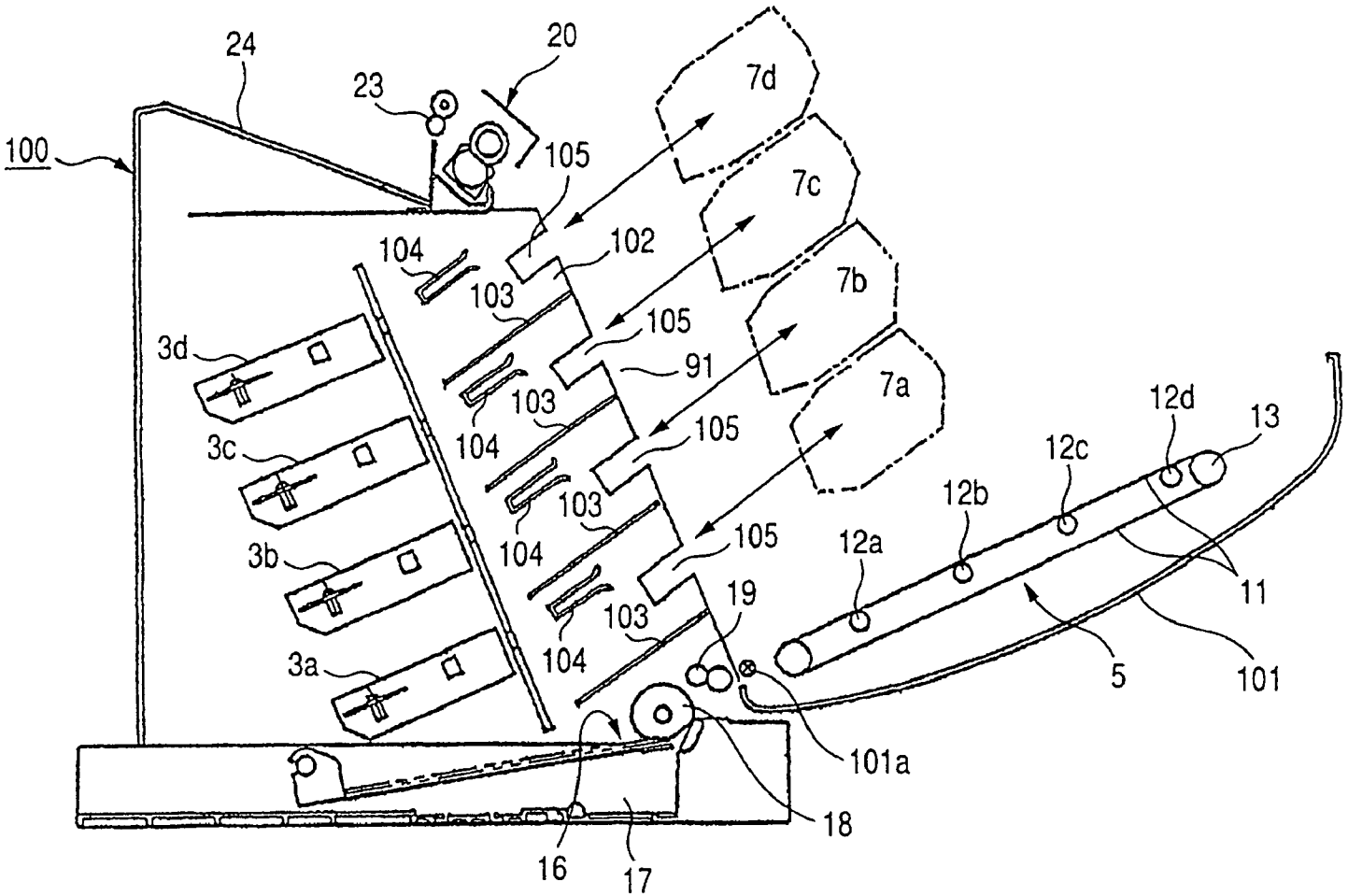
FIG. 6 is a schematic perspective view showing how respective process cartridges are mounted to the electrophotographic image forming apparatus main body.

Next, a method of mounting and detaching the cartridge to and from the apparatus main body 100 is described. As shown in FIGS. 2 and 6, the front cover 101 including the electrostatic transfer device 5 is tilted toward the front of the apparatus main body 100 about the hinge shaft 101*a* at a lower part, thus opening the front cover 101. This operation causes the cartridge insertion opening 91 inside the apparatus main body 100 to be fully exposed.

At the insertion opening 91, the four, that is, the first to fourth, cartridges (7*a* to 7*d*) are arranged from bottom to top in this order.

The operator holds the cartridge while gripping the grip portions 90 on the right and left sides of the cartridge with the right and left hands. The cartridge is then inserted into the insertion opening 9 from the back side of the cartridge which is on the side opposite from the photosensitive drum side as seen in the lateral direction of the cartridge. Then, the right and left side portions of the cartridge are each placed onto a rough guide portion 103. As the cartridge is further inserted, an insertion guide portion 53 in each of the right and left side portions of the cartridge rides onto a main body guide portion 104. The cartridge is then lifted upward out of the rough guide portion 103 to be guided by the main body guide portion 104.

As the cartridge is further inserted into the apparatus main body 100, each of the supporting members 31*a* and 31*b* on the right and left sides of the cartridge is inserted into a guide groove 105. Then, each of the supporting members 31*a* and 31*b* abuts an abutment surface of the guide groove 105, thus restricting further insertion of the cartridge. Thus, the position in the lateral direction of the cartridge with respect to the apparatus main body 100 is determined. After thus inserting the corresponding cartridge into each insertion opening, the opened front cover 101 is closed with respect to the apparatus main body 100.

The detachment of the respective cartridges from the apparatus main body 100 is effected through a procedure reverse to that for mounting the same described above.

(4) [Developing Blade 44]

Next, the developing blade is described with reference to FIGS. 7, 8A, 8B, 12A, and 12B.

Figure 7:
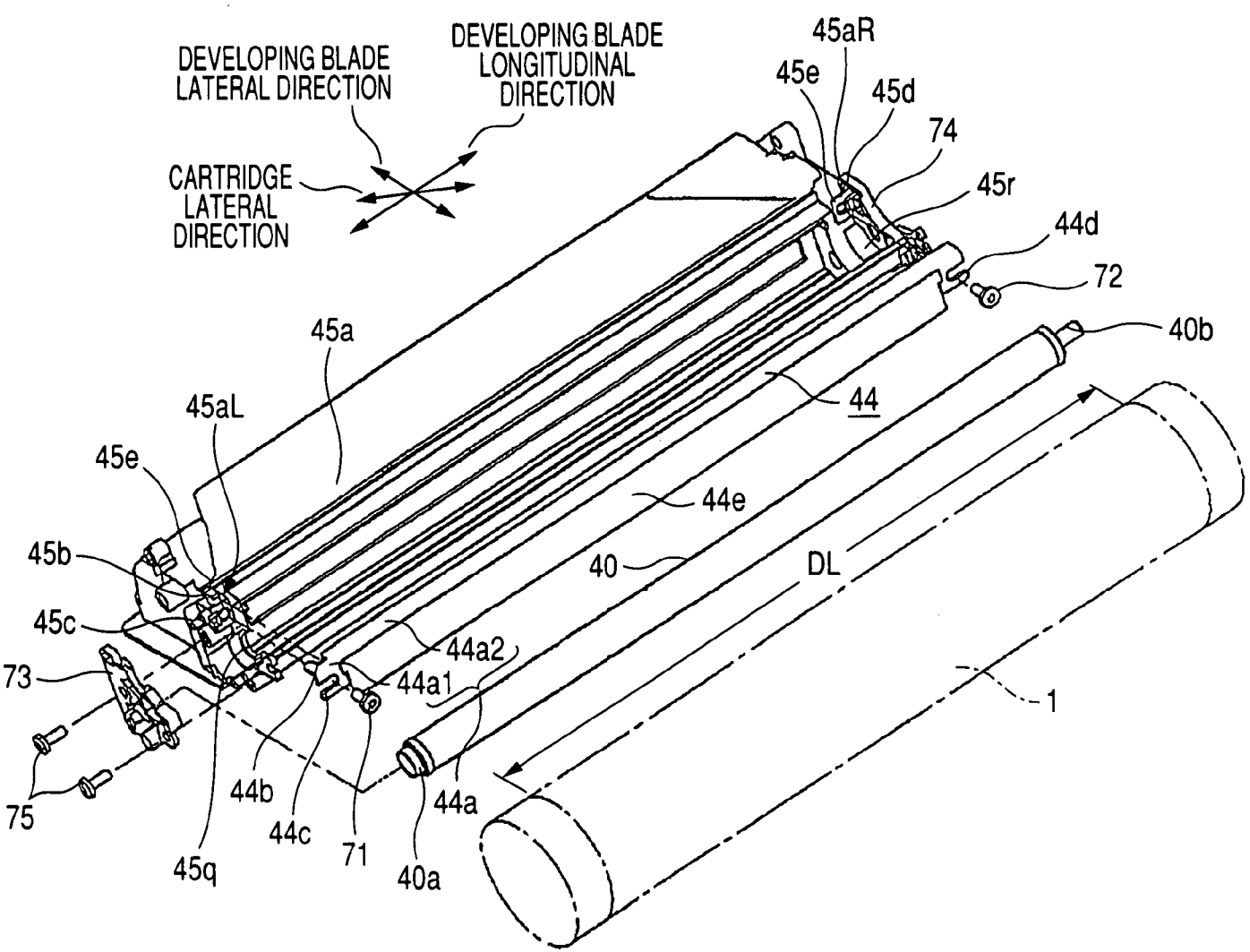
FIG. 7 is an explanatory view showing the relationship among a developing frame, a developing blade, a developing sleeve, a projecting portion of the developing frame, and an image formation region on a photosensitive drum.
Figure 8A:
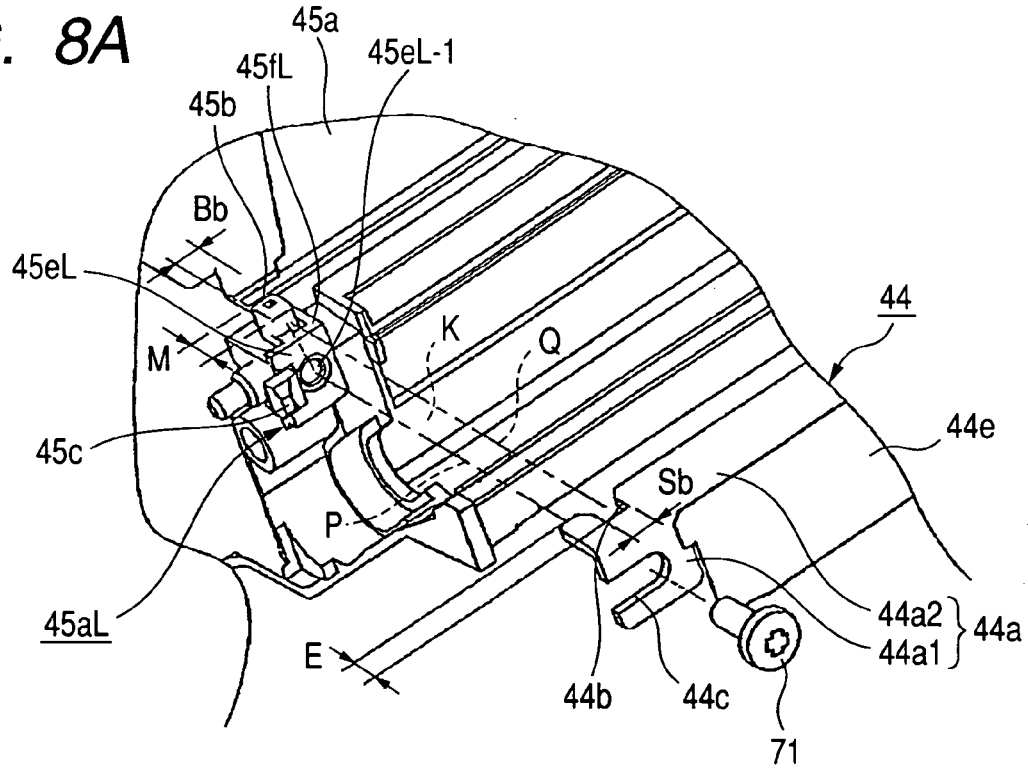
FIG. 8A is an enlarged perspective view of respective left end portions of the developing blade and the developing frame according to Embodiment 1 of the present invention.
Figure 8B:
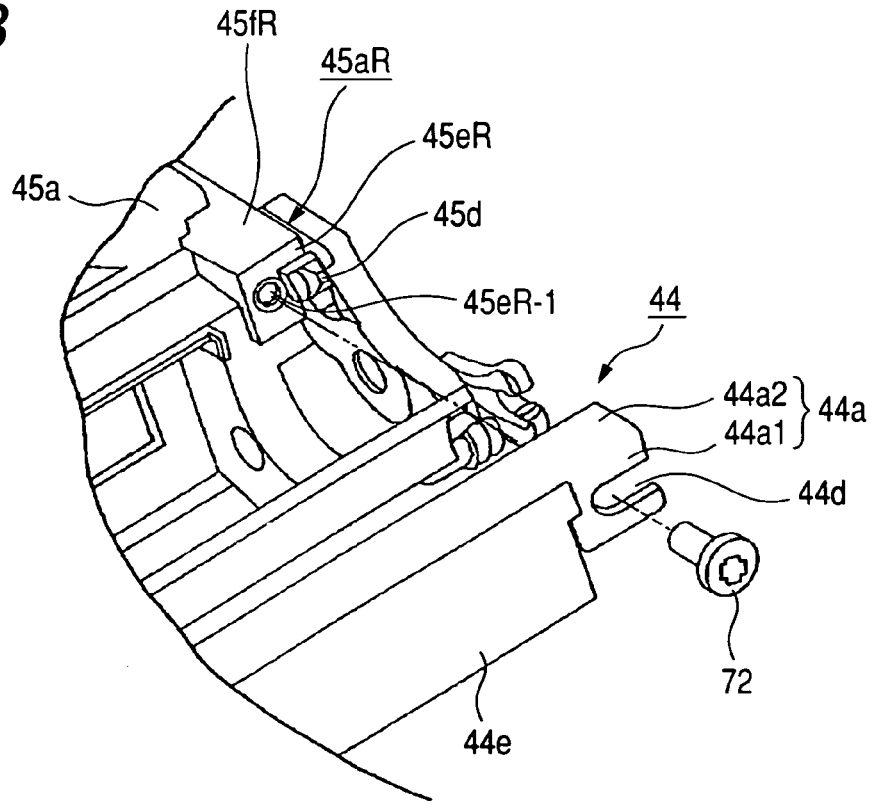
FIG. 8B is an enlarged perspective view of respective right end portions of the same.
Figure 12A:
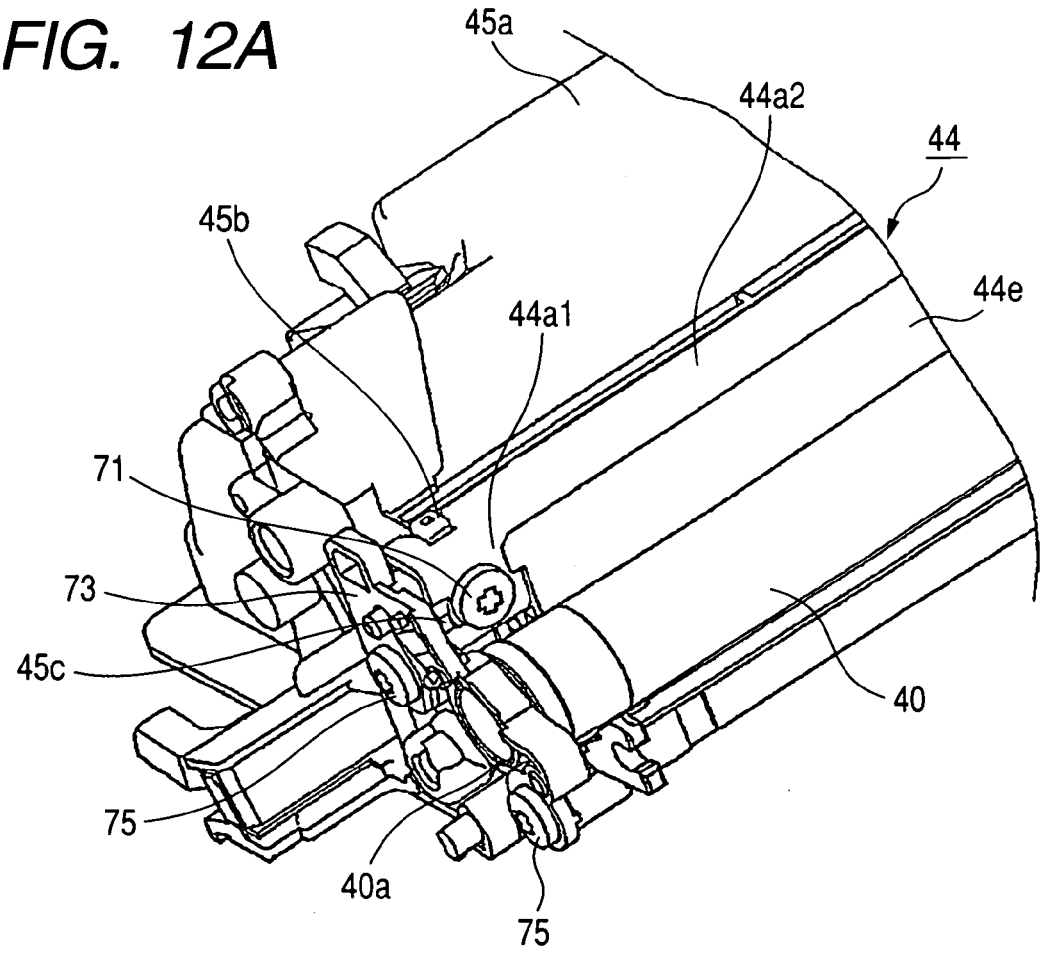
FIG. 12A is an enlarged perspective view of the left end side of the developing frame to which the developing blade has been fixed with screws.
Figure 12B:
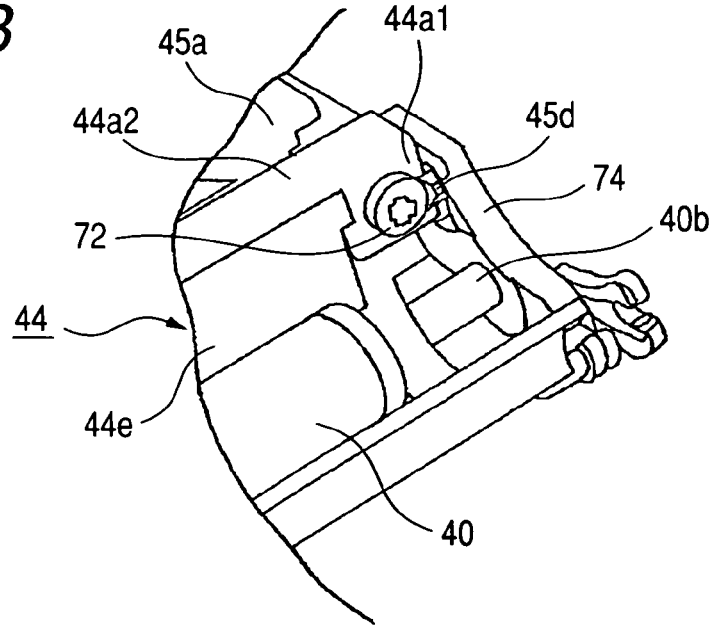
FIG. 12B is an enlarged perspective view of the right end side of the developing frame.

FIG. 7 is an explanatory view showing the exterior appearance of the developing blade 44 and the developing sleeve 40 and also illustrating the positional relation between projecting portions 45*b*, 45*c*, and 45*d* provided in the developing frame 45*a* and an image formation region DL on the photosensitive drum 1. FIGS. 8A and 8B are enlarged perspective views of left and right end portions, respectively, of the developing blade 44 and the developing frame 45*a* shown in FIG. 7. FIGS. 12A and 12B are an enlarged perspective view of the left end portion side, and an enlarged perspective view of the right end portion side, respectively, of the developing frame 45*a* to which the developing blade 44 is fixed with screws.

As shown in FIGS. 7, 12A, and 12B, the developing blade 44 is fixed to the developing frame 45*a* with screws 71 and 72. The developing sleeve 40 is arranged in sleeve mounting portions 45*q* and 45*r* of the developing frame 45*a* so as to be in close proximity to the developing blade 44. Further, shafts 40*a* and 40*b* of the developing sleeve 40 are rotatably supported by left and right bearing members 73 and 74, respectively. Further, the bearing members 73 and 74 are fixed to bearing member mounting portions at the left and right end portions, respectively, of developing frame 45*a* with screws 75. Thus, the developing blade 44 and the developing sleeve 40 are mounted to the developing frame 45*a* in parallel to the longitudinal direction of the cartridge.

The developing blade 44 is an elongate member having substantially the same length as the developing sleeve 40. In this embodiment, the developing blade 44 includes a blade supporting member (hereinafter referred to as the "supporting member") 44*a* and an elastic blade (hereinafter referred to as the "blade") 44*e*. However, the blade supporting member 44*a* and the blade 44*e* may also be integrated with each other. The supporting member 44*a* has a positioning member 44*a*1 (hereinafter referred to as the "first positioning member") serving as a first surface, and a positioning member 44*a*2 (hereinafter referred to as the "second positioning member") serving as a second surface. Here, the first positioning member and the second positioning member may not be formed as surfaces; protrusions or the like may be provided to constitute surfaces for mounting the developing blade 44 to the developing frame 45*a*. The supporting member 44*a* is formed in a substantially L-shaped configuration, with the first positioning member and the second positioning member crossing each other at substantially a right angle. The first positioning member 44*a*1 and the second positioning member 44*a*2 are bent with respect to each other. That is, the first positioning member 44*a*1 and the second positioning member 44*a*2 are oriented in different directions. In other words, a first imaginary plane, along which the first positioning member 44*a*1 is extended in an imaginary dimension, and a second imaginary plane, along which the second positioning member 44*a*2 is extended in an imaginary dimension, cross each other. The first positioning member 44*a*1 and the second positioning member 44*a*2 are thus different from each other. In this embodiment, an example is shown in which the second positioning member 44*a*2 is bent at substantially a right angle relative to the first positioning member 44*a*1. However, it suffices that the first positioning member 44*a*1 and the second positioning member 44*a*2 be oriented in different directions so as to cross each other. In this case, a first position setting portion and a second position setting portion are provided in the developing frame 45*a* in correspondence with the first positioning member 44*a*1 and the second positioning member 44*a*2. The first position setting portion and the second position setting portion are also formed in configurations in conformity with the configurations of the respective positioning members as they cross each other. Each of the first positioning member 44*a*1 and the second positioning member 44*a*2 described above is provided so as to be in parallel to the developing sleeve 40 as mounted to the developing frame 45*a*. Accordingly, the assembly of the developing blade 44 is easy. Used as the supporting member 44*a* is a steel plate (SPCC) having a board thickness of 1.2 mm and whose surface is subjected to KN plating. The blade 44*e* is fixed to the first positioning member 44*a*1 of the supporting member 44*a* by appropriate fixing means such as welding. Used as the blade 44*e* is phosphor bronze having a board thickness of 0.10 mm with a resin coat on the order of 30 μm applied on its surface.

The developing frame 45*a* has on its longitudinal left and right side end portions position setting portions 45*a*L and 45*a*R for setting the mounting positions where the developing blade 44 is mounted to the developing frame 45*a*, respectively. Each of the position setting portions 45*a*L and 45*a*R extends parallel to the developing roller 40. The position setting portions 45*a*L and 45*a*R include first position setting surfaces 45*e*L and 45*e*R, respectively, which are opposed to the first positioning member 44*a*1 of the supporting member 44*a*. The first position setting surfaces 45*e*L and 45*e*R face the lateral direction of the cartridge. Here, the position setting portions 45*a*L and 45*a*R further include second position setting surfaces 45*f*L and 45*f*R which cross the first position setting surfaces 45*e*L and 45*e*R at substantially right angles, respectively. Provided in the first position setting surfaces 45*e*L and 45*e*R are the projecting portions 45*c* and 45*d* for effecting positioning on the developing blade 44 in its lateral direction. In this embodiment, the lateral direction of the developing blade 44 refers to the direction that crosses the lateral direction of the cartridge and also crosses the longitudinal direction of the developing blade 44. Further, provided on one of the second position setting surfaces 45*f*L and 45*f*R (45*f*L in the figure) is the projecting portion 45*b* for effecting positioning on the developing blade 44 in its longitudinal direction. In this embodiment, the longitudinal direction of the developing blade 44 is the same direction as the longitudinal direction of the cartridge. Further, the longitudinal direction of the developing sleeve 40 is also the same direction as the longitudinal direction of the cartridge.

The projecting height of the projecting portions 45*a* and 45*d* from the first position setting surfaces 45*e*L and 45*e*R is larger than the thickness of the first positioning member 44*a*1. Further, the projecting height of the projecting portion 45*b* from the second position setting surface 45*f*L is larger than the thickness of the second positioning member 44*a*2. Further, in the longitudinal direction of the developing blade 44, the projecting portion 45*b* is located outside of the image formation region DL on the photosensitive drum 1. Further, in the longitudinal direction of the developing blade 44, the projecting portions 45*c* and 45*d* are located outside of the projecting portion 45*b*.

Groove portions 44*c* and 44*d* serving as first positioning portions are provided at end portions of the first positioning member 44*a*1 in the longitudinal direction of the developing blade 44. The groove portions 44*c* and 44*d* are cut open in the longitudinal direction of the developing blade 44, each having a substantially U-shaped configuration. This construction makes it possible to reduce the size of the developing blade 44 in the longitudinal direction as compared with the case where hole portions are provided to effect positioning. This is because when providing such hole portions, in order to ensure the positional accuracy of the hole portions, it is necessary to enlarge the hole portions at the outer side edges in the longitudinal direction. Further, the above construction also improves the workability of the assembly. On the other hand, provided at one end portion (the left end portion in the figure) of the second positioning member 44*a*2 is a groove portion 44*b* serving as a second positioning portion. In the second positioning member 44*a*2, the groove portion 44*b* is provided at an end portion on the side opposite from the developing sleeve 40. The groove portion 44*b* is cut open in the perpendicular direction (in the lateral direction of the cartridge in this example) with respect to the longitudinal direction of the developing blade 44, and has a substantially U-shaped configuration. This configuration of the groove portion 44*b* makes it possible to reduce the size of the cartridge in the lateral direction. Further, this configuration of the groove portion 44*b* allows the developing blade 44 to be smoothly assembled onto the developing frame 45*a* from the lateral direction of the cartridge. The groove portion 44*b* is formed as a groove that fits in the projecting portion 45*b* of the developing frame 45*a* in the longitudinal direction of the developing blade 44. That is, in the groove portion 44*b*, a width Sb between inner walls 44*b*-1 opposing each other in the longitudinal direction of the developing blade 44 is substantially equal to a width Bb between outer wall surfaces 45*b*-1 of the projecting portion 45*b* (Sb≈Bb). Further, a groove length E of the groove portion 44*b* in the lateral direction of the process cartridge is equal to or slightly larger than a depth M of the projecting portion 45*b* in the same direction (E≈M). Here, the groove length E of the groove portion 44*b* may be smaller than the depth M of the projecting portion 45*b*. Further, the forward end of the groove portion 44*b* is chamfered, which further facilitates fitting of the groove portion 44*b* in the projecting portion 45*b*.

The projecting portions 45*c* and 45*d* and the groove portions 44*c* and 44*d* mentioned above are now described in more detail with reference to FIGS. 9A and 9B.

Figure 9A:
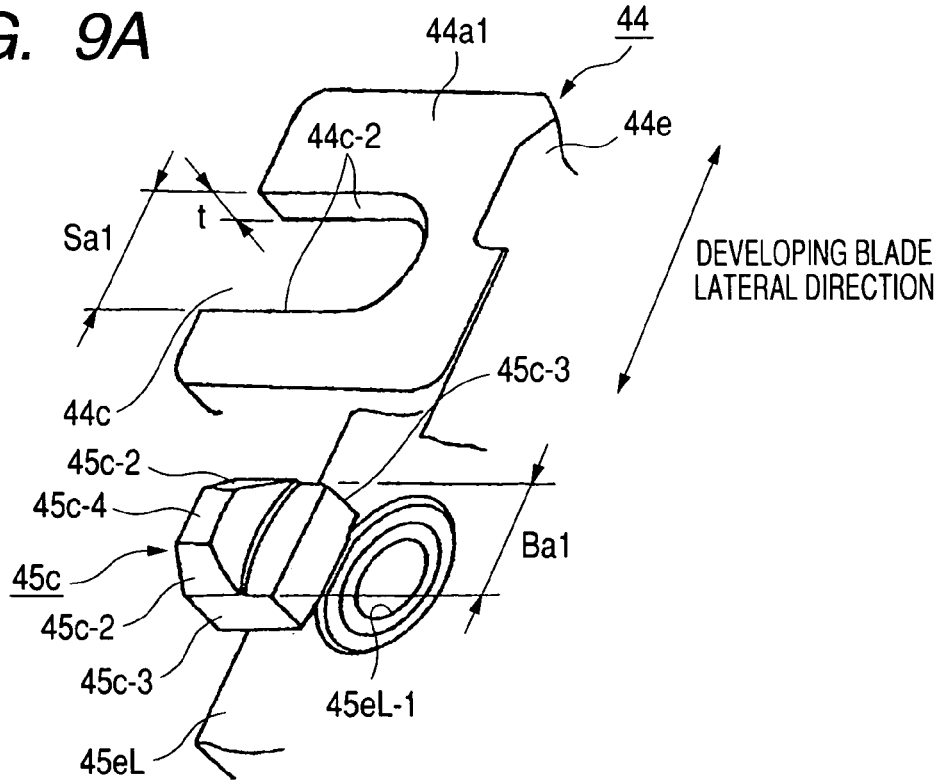
FIG. 9A is an enlarged perspective view showing respective positioning portions on the left end side of the developing frame and the developing blade.
Figure 9B:
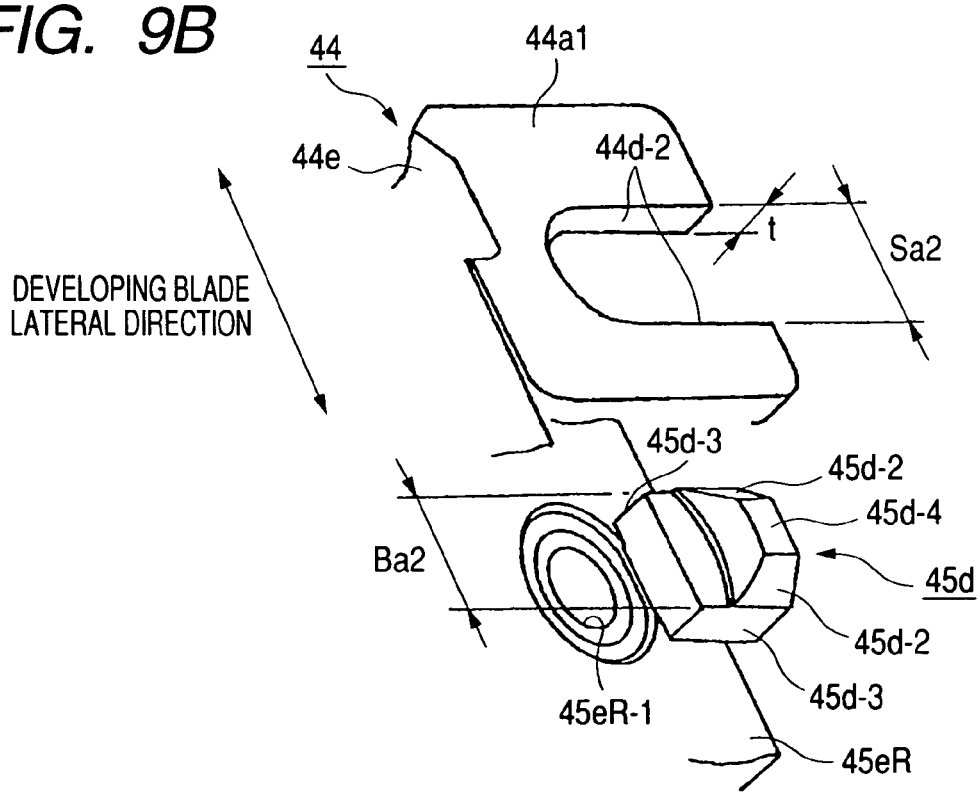
FIG. 9B is an enlarged perspective view showing respective positioning portions on the right end side of the same.

FIG. 9A is an enlarged perspective view of the positioning portions 45*c* and 44*c* on the left end portion side of the developing frame 45*a* and the developing blade 44, respectively. FIG. 9B is an enlarged perspective view of the positioning portions 45*d* and 44*d* on the right end portion side of the same.

The groove portions 44*c* and 44*d* are provided at longitudinal end portions of the first positioning member 44*a*1 of the developing blade 44. The groove portions 44*c* and 44*d* are each formed in the shape of a groove. The groove portions 44*c* and 44*d* fit in the projecting portions 45*c* and 45*d*, respectively, of the developing frame 45*a* in the lateral direction of the developing blade 44. That is, as shown in FIG. 9A, a width Sa1 between inner wall surfaces 44*c*-2 that oppose each other in the lateral direction of the developing blade 44 is substantially equal to a width Ba1 between outer wall surfaces 45*c*-3 of the projecting portion 45*c* (Sa1≈Ba1). As shown in FIG. 9B, a width Sa2 between inner wall surfaces 44*d*-2 that oppose each other in the lateral direction of the developing blade 44 is substantially equal to a width Ba2 between outer wall surfaces 45*d*-3 of the projecting portion 45*d* (Sa2≈Ba2).

While in this embodiment Sa1≈Ba1 and Sa2≈Ba2, the relationships Sa1≈Ba1 and Sa2>Ba2 may also be adopted. This makes it possible to effect adjustment on the developing blade 44 in its lateral direction with the developing blade 44 being assembled onto the developing frame 45*b*. At this time, fitting engagement between the projecting portion 45*b* and the groove portion 44*b* effects positioning in the longitudinal direction of the developing blade 44. Accordingly, it is possible to effect adjustment only in the lateral direction of the developing blade 44. In this way, it is possible to ensure the accuracy in the lateral direction of the developing blade 44 which is subject to a high accuracy requirement.

Next, the assembly of the developing blade 44 is described with reference to FIGS. 7, 8A, 8B, 10A, 10B, and 10C.

Figure 10A:
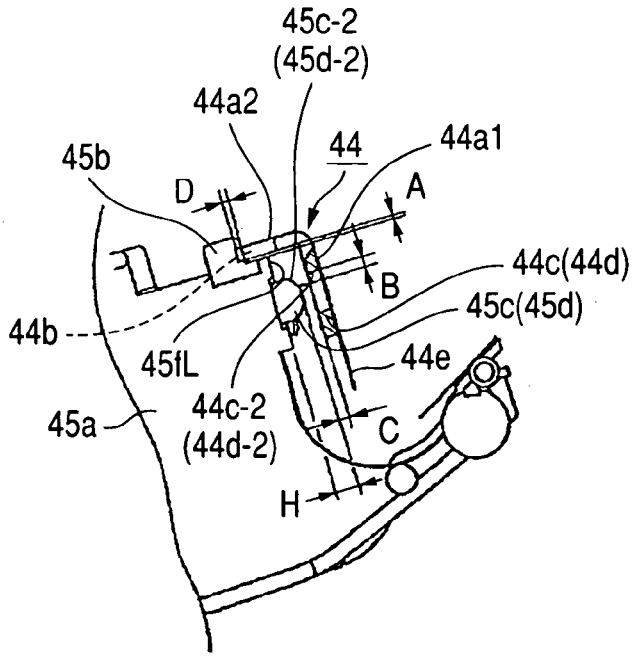
FIGS. 10A, 10B, and 10C are explanatory views showing how the developing blade is assembled onto the developing frame.
Figure 10B:
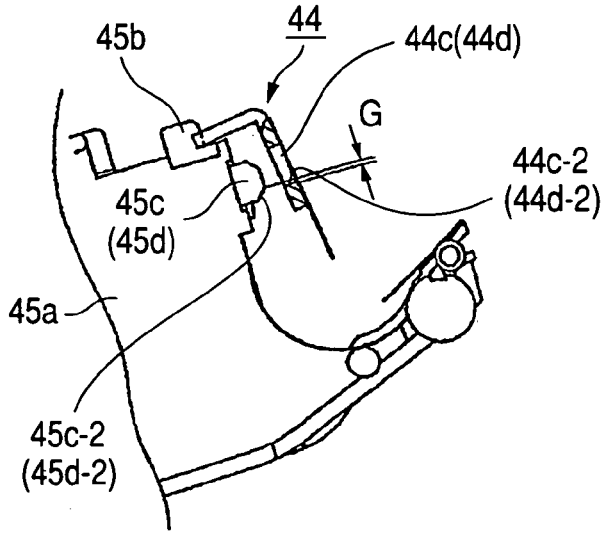
Figure 10C:
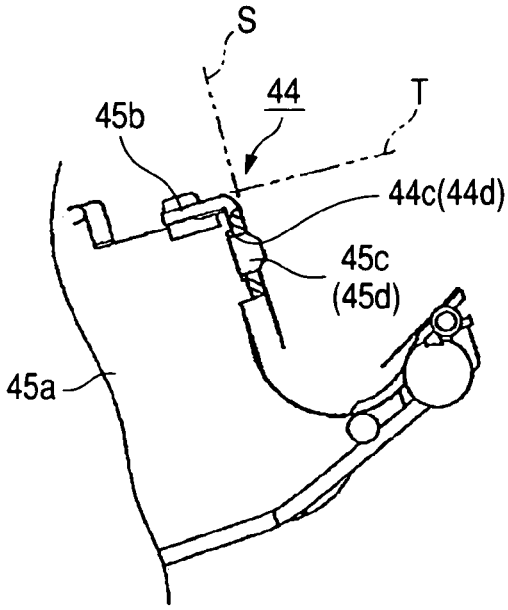

FIG. 10A is a view illustrating how positioning is effected on the second positioning member 44*a*2 of the developing blade 44 with respect to the second position setting surface 45*f*L of the developing frame 45*a*. FIG. 10B illustrates that, in the state of FIG. 10A, the developing blade 44 is tilted with respect to the developing frame 45*a*. FIG. 10C is a view illustrating how positioning is effected on the first positioning member 44*a*1 of the developing blade 44 with respect to the first position setting surfaces 45*e*L and 45*e*R of the developing frame 45*a*. FIG. 10C illustrates that, as indicated by the two dot-chain lines, a first imaginary plane S, along which the first positioning member 44*a*1 is extended in an imaginary dimension, and a second imaginary plane T, along which the second positioning member 44*a*2 is extended in an imaginary dimension, cross each other.

As shown in FIGS. 7, 8A, and 8B, when assembling the developing sleeve 44 onto the developing frame 45*a*, the first positioning member 44*a*1 of the supporting member 44*a* is opposed parallel to the first position setting surface 45*e*L. Then, as shown in FIG. 10A, the developing blade 44 is moved parallel to the lateral direction of the cartridge. Subsequently, the groove portion 44*b* of the second positioning member 44*a*2 is fitted in the projecting portion 45*b*.

The positioning of the groove portion 44*a* with respect to the projecting portion 45*b* thus begins.

In the state as shown in FIG. 10A, a projecting height H of the projecting portions 45*c* and 45*d* is set such that, even when a predetermined fitting length D is produced between the groove portion 44*b* and the projecting portion 45*b*, a space (gap C) exists between the first positioning member 44*a*1 and respective top surfaces 45*c*-4 and 45*d*-4 of the projecting portions 45*c* and 45*d*. By setting the projecting height H in this way, during assembly of the developing blade 44, the groove portion 44*b* can be fitted in the projecting portion 45*b* first.

A gap A is provided between the second positioning member 44*a*2 and the position setting surface 45*f*L with the groove portion 44*b* being fitted in the projecting portion 45*b*. This facilitates fitting of the groove portions 44*c* and 44*d* of the first positioning member 44*a*1 in the projecting portions 45*c* and 45*d*, respectively. In this connection, as shown in FIGS. 9A and 9B, slopes 45*c*-2 and 45*d*-2 are provided in part of the outer wall surfaces 45*c*-3 and 45*d*-3 on the second projecting portion 45*b* side of the projecting portions 45*c* and 45*d*, respectively. The slopes 45*c*-2 and 45*d*-2 slant from the top surfaces 45*c*-4 and 45*d*-4 toward the outer wall surfaces 45*c*-3 and 45*d*-3, respectively, with the width of the slopes increasing toward the outer wall surfaces. Here, the thickness of the outer wall surfaces 45*c*-3 and 45*d*-3 exceeds a thickness t of the first positioning member 44*a*1. In this way, a gap B is provided between the respective top surface side corner portions of the slopes 45*c*-2 ad 45*d*-2 and the respective inner wall surfaces 44*c*-2 and 44*d*-2 of the groove portions 44*c* and 44*d*. The gap B is larger than the gap A mentioned above (B>A). This makes it easier to fit the groove portions 44*c* and 44*d* in the projecting portions 45*c* and 45*d*, respectively, even when the gap A=0 (the gap A becomes zero) upon assembling the developing blade 44.

Further, there are cases where, with the groove portion 44*b* being fitted in the projecting portion 45*b*, the second positioning member 44*a*2 is tilted so as to move away from the position setting surface 45*f*L on the first positioning member 44*a*1 side. In such a case, it may become difficult to fit the groove portions 44*c* and 44*d* in the projecting portions 45*c* and 45*d*, respectively. In view of this, as shown in FIGS. 9A and 9B, slopes 45*c*-2 and 45*d*-2 are formed in part of the outer wall surfaces 45*c*-3 and 45*d*-3 of the projecting portions 45*c* and 45*d* on the side opposite to the second projecting portion 45*b* side, respectively. The slopes 45*c*-2 and 45*d*-2 slant from the top surfaces 45*c*-4 and 45*d*-4 toward the outer wall surfaces 45*c*-3 and 45*d*-3, respectively, with the width of the slopes increasing toward the outer wall surfaces. Further, a gap G is provided between the respective top surface side corner portions of the slopes 45*c*-2 and 45*d*-2 and the respective inner wall surfaces 44*c*-2 and 44*d*-2 of the groove portions 44*c* and 44*d*. This makes it easier to fit the groove portions 44*c* and 44*d* in the projecting portions 45*c* and 45*d* even when the second positioning member 44*a*2 is tilted relative to the position setting surface 45*f*L.

In summary, the projecting portions 45*c* and 45*d* are formed in a trapezoidal configuration as seen from the longitudinal direction of the developing blade 44. This makes it easier to fit the groove portions 44*c* and 44*d* in the projecting portions 45*c* and 45*d*.

The developing blade 44 in the state of FIG. 10A is further moved in the lateral direction of the cartridge 7. Thus, the relationship between the fitting length D and the gap C described above changes from the "fitting length D=gap C" to "fitting length D>gap C". Further, at the time when the gap C=0, the positioning of the groove portions 44*c* and 44*d* with respect to the projecting portions 45*c* and 45*d* begins. Then, as the developing blade 44 moves in the lateral direction of the cartridge 7, the projecting portions 45*c* and 45*d* fit in and enter the groove portions 44*c* and 44*d*, respectively. The back surface of the first positioning member 44*a*1 then comes into abutment with the first position setting surface 45*e*L, thus completing the assembling of the developing blade 44 onto the developing frame 45*a*.

As shown in FIGS. 12A and 12B, in the state where the assembling of the developing blade 44 is complete, the projecting portion 45*b* is fitted in the width Sb between the opposing inner wall surfaces of the groove portion 44*b* of the first positioning member 44*a*1 in the developing blade 44. The outer surface of the projecting portion 45*b* and the opposing inner wall surfaces 44*b*-1 come into abutment with each other. As a result, positioning is effected on the developing blade 44 with respect to the developing frame 45*a* in the longitudinal direction of the developing blade. At the same time, the projecting portions 45*c* and 45*d* are fitted in the widths Sa1 and Sa2 between the opposing inner wall surfaces of the groove portions 44*c* and 44*d*, respectively. Then, the outer wall surfaces 45*c*-3 and 45*d*-3 of the projecting portions 45*c* and 45*d* and the opposing inner wall surfaces 44*c*-2 and 44*d*-2 of the groove portions 44*c*, 44*d* come into abutment with each other, respectively. As a result, positioning is effected on the developing blade 44 with respect to the developing frame 45*a* in the lateral direction of the developing blade. Further, the projecting portions 45*c* and 45*d* are provided at positions closer to the developing sleeve 40 than that of the projecting portion 45*b*. With this arrangement, the positioning on the developing blade 44 with respect to the developing sleeve 40 can be effected with improved accuracy in the lateral direction of the developing blade 44.

Lastly, the screws 71 and 72 are inserted though the groove portions 44*c* and 44*d*, respectively, in the lateral direction of the cartridge 7. Then, the screw 71 is screwed in the space of the width Sa1 between the opposing inner wall surfaces of the groove portion 44*c*, into a screw hole 45*e*L-1 provided in the second position setting surface 45*e*L. At the same time, the screw 72 is screwed in the space of the width Sa2 between the opposing inner wall surfaces of the groove portion 44*d*, into a screw hole 45*e*R-1 provided in the second position setting surface 45*e*R. As a result, the developing blade 44 is fixed onto the developing frame 45*a*.

Figure 11A:
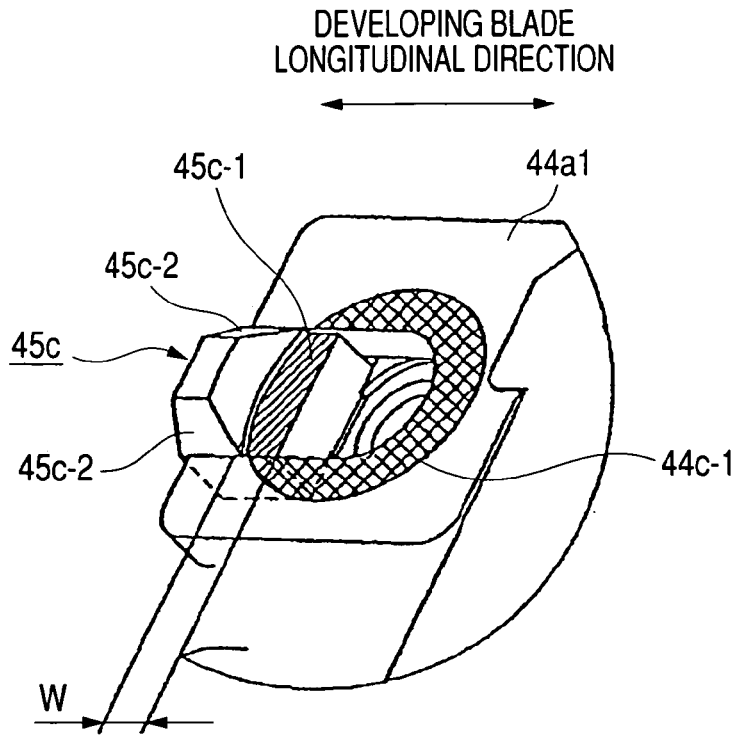
FIG. 11A is a view for explaining the relationship between a projecting portion 45*c* on the left end side of the developing frame 45*a* and a screw 71.
Figure 11B:
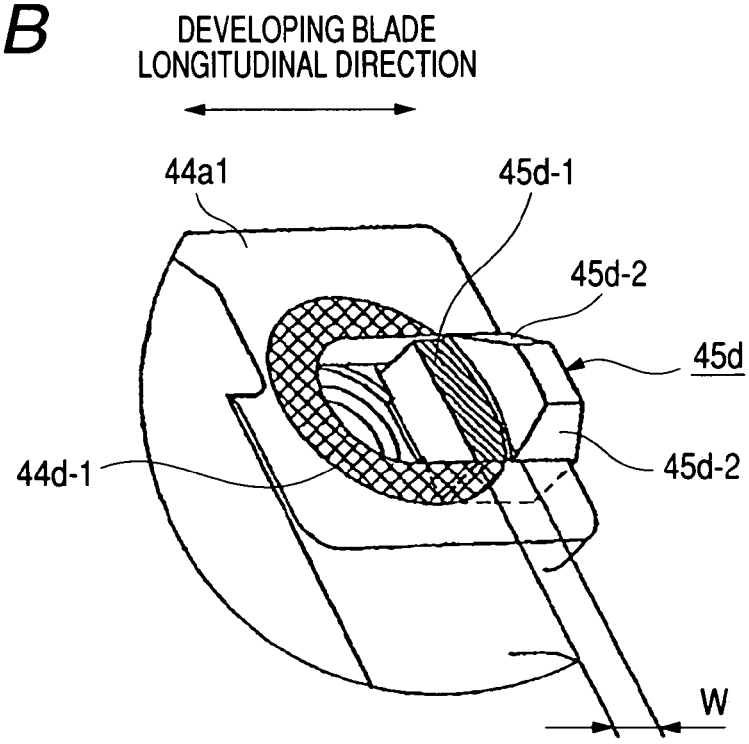
FIG. 11B is a view for explaining the relationship between the projecting portion 45*c* on the right end side and the screw 71.

Referring now to FIGS. 11A and 11B, the relationship between the screws 71 and 72, and the projecting portions 45*c* and 45*d* is described.

FIG. 11A is a view for explaining the relationship between the projecting portion 45*c*, provided on the left end portion side of the developing frame 45*a*, and the screw 71. Further, FIG. 11B is a view for explaining the relationship between the projecting portion 45*d*, provided on the right end portion side of the same, and the screw 72.

The projecting portions 45*c* and 45*d* fitted in the groove portions 44*c* and 44*d* have regions 45*c*-1 and 45*d*-1, respectively, which become hidden as the screws are tightened. Those regions 45*c*-1 and 45*d*-1 are formed one step lower with respect to abutment regions 44*c*-1 and 44*d*-1 in the surface of the first positioning member 44*a*1 with which the seating surfaces of the screws 71 and 72 abut, respectively. Due to this arrangement, the screws 71 and 72 do not come into contact with the regions 45*c*-1 and 45*d*-1 of the projecting portions 45*c* and 45*d*, respectively. However, the abutment regions 44*c*-1 and 44*d*-1 in the surface of the first positioning member 44*a*1 abut on the seating surfaces of the screws 71 and 72, respectively. In this state, the screws 71 and 72 are respectively screwed into the screw holes 45*e*L-1 and 45*e*R−1 and tightened. In this way, the screws 71 and 72 and the blade supporting member 44*a* are brought into abutment with each other. At this time, no unnecessary force is applied to the projecting portions 45*c* and 45*d* by the screws 71 and 72. Therefore, the fixing of the developing blade 44 onto the developing frame 45*a* is effected with good accuracy. Further, in the longitudinal direction of the developing blade 44, the projecting portions 45*c* and 45*d* are in fitting engagement with the groove portions 44*c* and 44*d*, respectively, even at the portions of the regions 45*c*-1 and 45*d*-1. Accordingly, a large fitting length, equivalent to a width W of the regions 45*c*-1 and 45*d*-1, can be secured between the projecting portions 45*c* and 45*d* and the groove portions 44*c* and 44*d*.

In this embodiment, in the developing frame 45*a*, the projecting portion 45*b* provided on the first position setting surface 45*f*L is located outside of the image formation region DL on the photosensitive drum. Therefore, even when a large height is set for the projecting portion 45*b*, the projecting portion 45*b* does not block the laser beam (image light) L used for latent image formation. Further, as shown in FIG. 8A, a plane K, which is formed by connecting together a center line P of the screw hole 45*e*L-1 into which the screw 71 is inserted and a center line Q passing through the center of the projecting portion 45*b*, extends in the direction orthogonal to the longitudinal direction of the developing blade 44. With this arrangement, as compared with the case where a developing blade positioning boss (not shown) is provided at a position spaced apart from the screw 71, it is possible to prevent the developing blade 44 from becoming tilted during the fastening process as the screw 71 is screwed into the screw hole 45*e*L−1 and fastened.

In this way, the groove-like positioning member 44*b* provided in the second positioning member 44*a*2 is fitted in the projecting portion 45*b* of the developing frame 45*a*. The position of the developing blade 44 in the lateral direction is thus determined. Further, the groove-like positioning members 44*c* and 44*d* provided in the first positioning member 44*a*1 are fitted in the projecting positioning members 45*c* and 45*d* of the developing frame 45*a*, respectively. As a result, the position of the developing blade 44 in the lateral direction is determined.

Figure 13A:
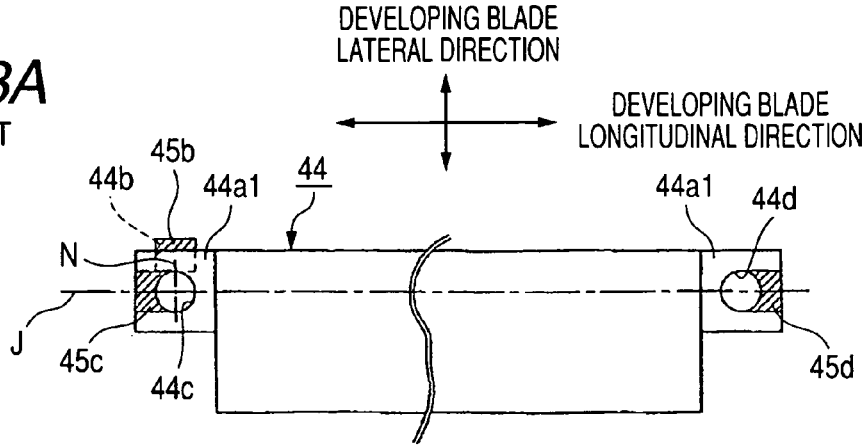
FIG. 13A illustrates the positional relation between a groove portion of the developing blade and the projecting portion of the developing frame according to Embodiment 1 of the present invention.

By the above-described groove portions 44*b* to 44*d*, positioning is effected on the developing blade 44 with respect to the developing frame 45*a*. As shown in FIG. 13A, the groove portions 44*c* and 44*b* can be overlapped in position in the longitudinal direction of the developing blade 44. Further, in the longitudinal direction of the developing blade 44, the groove portions 44*c* and 44*b* can also be provided at the same position of the first positioning member 44*a*1 and the second positioning member 44*a*2, respectively. This arrangement enables a further reduction in the size of the developing blade 44. Accordingly, as compared with the generally adopted positioning method as shown in each of FIGS. 13B and 13C in which positioning is effected on a developing blade 144, 244 by means of a round boss 145*c*, 245*c*, it is possible to miniaturize the developing blade 44 in both the longitudinal and lateral directions. Further, as described above, the center line of the screw hole 45*e*L-1 that receives the screw 71 and a center line N passing though the center of the projecting portion 45*b* are arranged so as to be orthogonal to the longitudinal direction of the developing blade 44. Further, the center line of the screw hole 45*e*L-1 and a center line J passing through the center of the projecting portion 45*c* are arranged so as to be parallel to the longitudinal direction of the developing blade 44. With the above arrangements, the developing blade 44 can be mounted to the developing frame 45*a* while suppressing the tilting of the developing blade 44, thus improving the workability of assembly. By overlapping at least the screw hole 45*e*L-1 and the projecting portion 45*b* in position in the longitudinal direction of the developing blade 44, the workability of mounting is improved. Further, the workability of mounting is also improved by overlapping the screw hole 45*e*L-1 and the projecting portion 45*c* in position in the longitudinal direction of the developing blade 44.

Figure 13B:
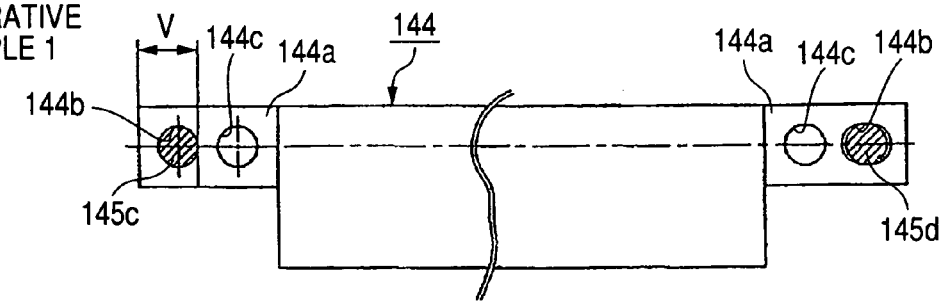
FIG. 13B illustrates the positional relation between the groove portion of the developing blade and the projecting portion of the developing frame according to Comparative Example 1.

That is, in Comparative Example 1 shown in FIG. 13B, a supporting member 144*a* for the developing blade 144 is formed in a thin plate-like configuration, and a round screw insertion hole 144*c* and a positioning boss 144*b* are arranged side by side in the longitudinal direction of the developing blade 144 in each of the right and left side portions of the supporting member 144*a*. In Comparative Example 1, each of the round bosses 145*c* and 145*d* provided in a developing frame body (not shown) is fitted in the corresponding positioning boss 144*b*. Positioning is thus effected on the developing blade 144 with respect to the developing frame. In this case, as shown in FIG. 13B, a space indicated by V is required in the longitudinal direction of the developing blade 144. In the developing blade 44 of this embodiment, however, the groove portion 44*b* equivalent to the positioning boss 144*b* is provided in the second positioning member 44*a*2 different from the first positioning member 44*a*1. Therefore, the above-mentioned space V is not required, allowing a corresponding reduction in the longitudinal size of the developing blade 44.

Figure 13C:
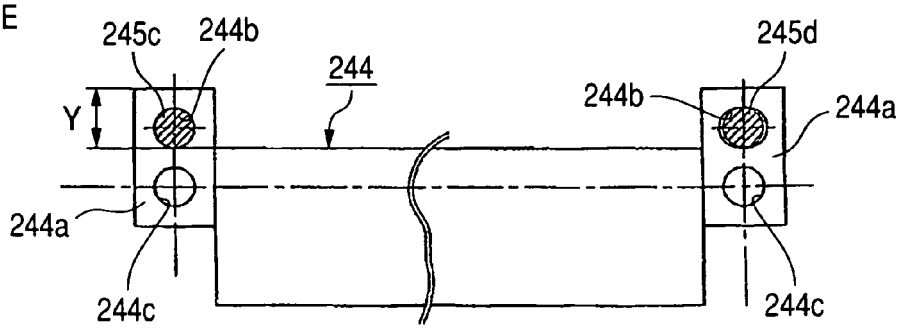
FIG. 13C illustrates the positional relation between the groove portion of the developing blade and the projecting portion of the developing frame according to Comparative Example 2.

Further, in Comparative Example 2 shown in FIG. 13C, a supporting member 244*a* for the developing blade 244 is formed in a thin plate-like configuration, and a round screw insertion hole 244*c* and a positioning boss 244*b* are arranged side by side in the lateral direction of the developing blade 244 in each of the right and left side portions of the supporting member 244*a*. In Comparative Example 2, each of the round bosses 245*c* and 245*d* provided in a developing frame body (not shown) is fitted in the corresponding positioning boss 244*b*. Positioning is thus effected on the developing blade 244 with respect to the developing frame. In this case, as shown in FIG. 13C, a space indicated by Y is required in the lateral direction of the developing blade 244. In the developing blade 44 of this embodiment, however, the groove portion 44*b* equivalent to the positioning boss 244*b* is provided in the second positioning member 44*a*2 different from the first positioning member 44*a*1. Therefore, the above-mentioned space Y is not required, allowing a corresponding reduction in the lateral size of the developing blade 44.

Accordingly, the developing blade 44 can be miniaturized in the longitudinal and lateral directions thereof. This makes it possible to bring the screw 71 used for fixing and the projecting portion 45*c* into close proximity with each other in the lateral direction of the process cartridge. As a result, the developing device and the process cartridge can be miniaturized. The arrangement of the groove portions 44*c* and 44*d* and the projecting portions 45*c* and 45*d* may be reversed.

Embodiment 2

In Embodiment 1, the description is directed to the developing blade 44 and the process cartridge equipped with the developing blade. However, the developing blade 44 may be provided to the developing device. In this case, the developing device is basically of the same construction as the developing unit 4A of the process cartridge described in Embodiment 1. As shown in FIG. 3, the developing device includes: the developing frames 45*a* and 45*b* that support the developing sleeve (developing roller) 40 rotating clockwise as indicated by the arrow, with a minute gap being maintained between the developing sleeve 40 and the photosensitive drum 1 by the spacer roller 40*a*; the toner supplying roller 43 that rotates clockwise as indicated by the arrow while in contact with the developing sleeve 40; and the developing blade 44. The developing frames 45*a* and 45*b* are jointed together by ultrasonic welding or the like, forming the developing container unit (developing container) 46. Further, provided inside the toner container portion (developer receiving portion) 41 in the developer container unit is the toner conveying mechanism 42 for stirring the toner contained in the toner container portion 41 and conveying the same toward the toner supplying roller 43. The developing device of this embodiment is detachably mountable to the electrophotographic image forming apparatus main body equipped with the photosensitive drum, the charging device, the cleaning device, and the like. Accordingly, also in the case where the developing blade 44 of Embodiment 1 is equipped to the developing device, the developing blade 44 can be miniaturized in the longitudinal and lateral directions, making it possible to achieve miniaturization of the developing device.

Embodiment 3

Figure 13D:
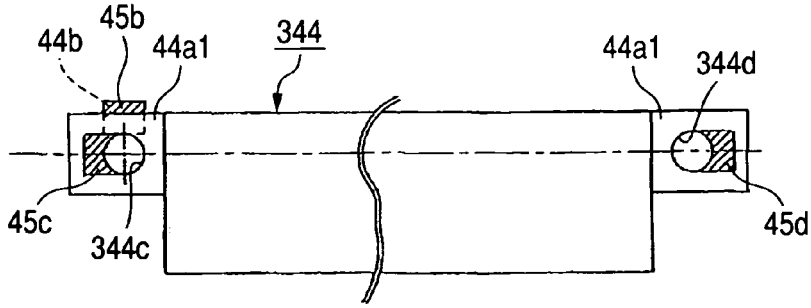
FIG. 13D illustrates the positional relation between the groove portion of the developing blade and the projecting portion of the developing frame according to Embodiment 3 of the present invention.
Figure 14A:
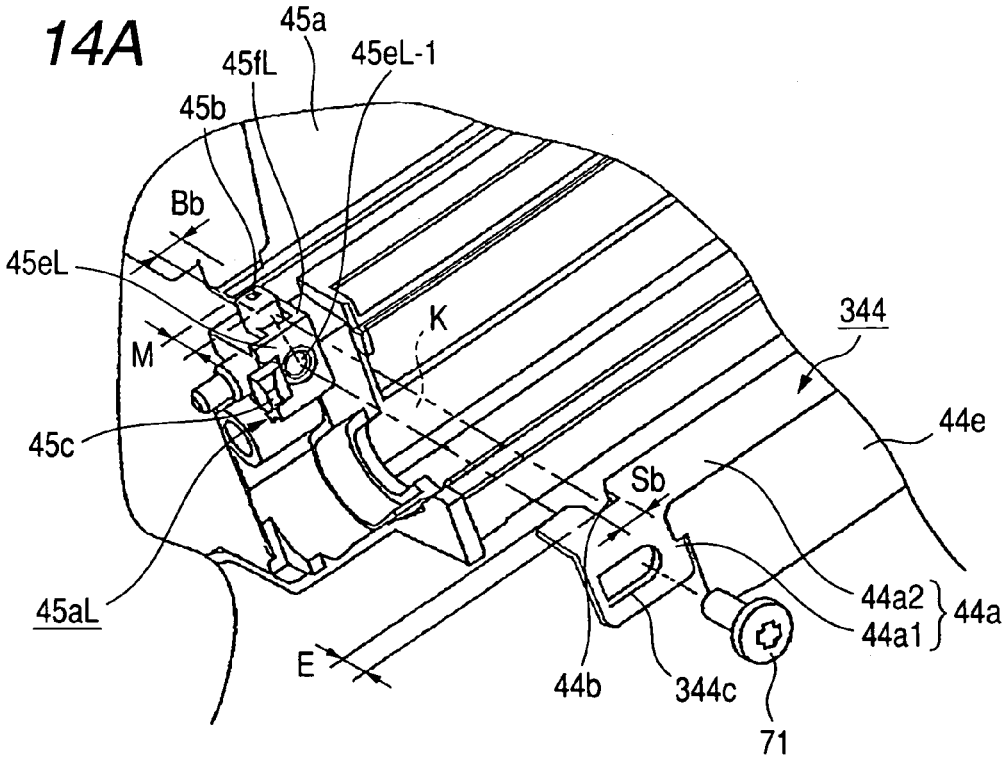
FIG. 14A is an enlarged perspective view of the respective left end portions of the developing blade and the developing frame according to Embodiment 3 of the present invention.
Figure 14B:
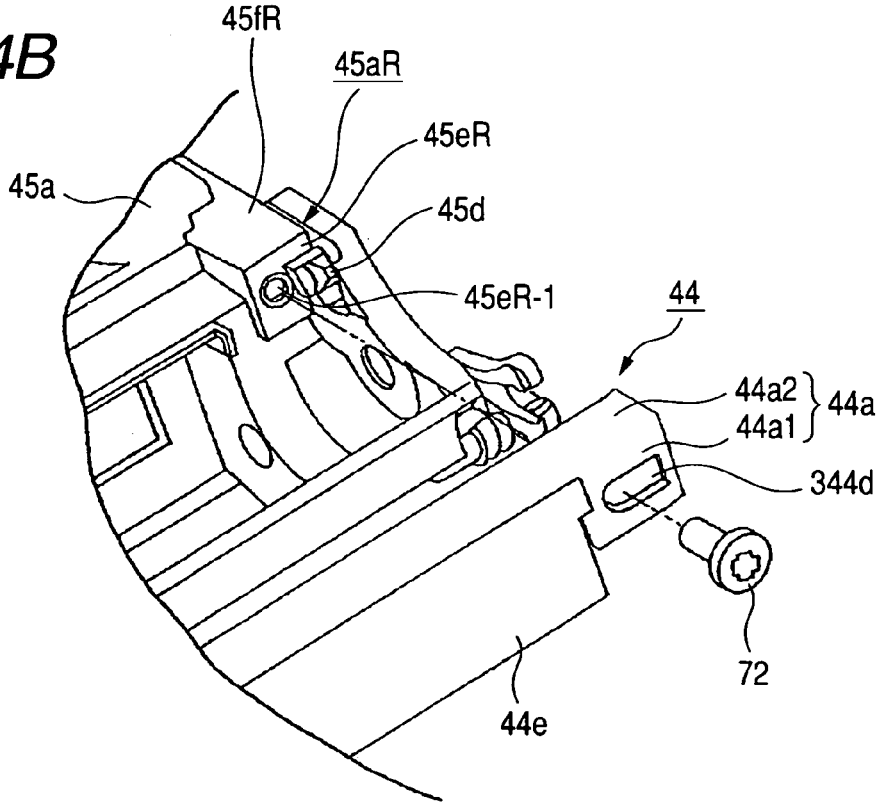
FIG. 14B is an enlarged perspective view of the respective right end portions of the same.

In Embodiments 1 and 2, the description is directed to the case of the groove portions 44*c* and 44*d* of a substantially U-shaped configuration which is cut open in the longitudinal direction of the developing blade 44. However, the groove portions 44*c* and 44*d* may not be cut open. That is, as shown in FIGS. 14A, 14B, and 13D, hole portions 344*c* and 344*d* are provided instead of the groove portions 44*c* and 44*d*. In this case, the construction other than the groove portions 44*c* and 44*d* is the same as that of Embodiment 1. Such an arrangement, too, makes it possible to achieve miniaturization of the developing blade. It is to be noted that in the construction of this embodiment, the longitudinal size of a developing blade 344 is slightly larger than the longitudinal size of the developing blade 44 of Embodiment 1.

OTHERS

1) As for the developing method, various known developing methods may be employed, such as a two-component magnetic brush developing method, a cascade developing method, a touch down developing method, and a cloud developing method.

2) Further, as to the structure of the charging means, while a so-called contact charging method is employed in the aforementioned embodiments, the following conventionally adopted structure may be employed alternatively, of course. That is, a metal shield made of aluminum is applied around three sides of a tungsten wire, and positive or negative ions generated by applying a high voltage to the tungsten wire are moved onto a photosensitive drum surface, thus uniformly charging the photosensitive drum surface.

It is to be noted that the charging means may be of the blade type (charging blade), a pad type, a block type, a rod type, a wire type, or the like, in addition to the roller type described above.

3) As for the method of cleaning the residual toner on the photosensitive drum, the cleaning means may be constituted of a blade, a fur brush, a magnetic brush, or the like.

4) The image bearing member is not limited to the electrophotographic photosensitive drum but may be one which forms an image by using a magnetic latent image. Further, the image bearing member may be an insulating drum or the like. Further, the image bearing member is not limited to a drum but may be a belt or the like.

5) While the foregoing description is directed to the case where one-component developer is used as the developer, the developer used is not limited to the one-component developer but may be a two-component developer including a carrier, or the like.

As has been described above, according to the present invention, it is possible to achieve miniaturization of the developer layer regulating member. Further, according to the present invention, it is possible to achieve an improvement in the workability of assembling of the developer layer regulating member onto the developer container.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 2004-144839 filed on May 14, 2004, which is hereby incorporated by reference herein.

What is claimed is:

1. A developing device for developing a latent image formed on an image bearing member by using developer, the developing device comprising:

a developing frame;

a developing roller configured and positioned to supply developer to the latent image to develop the latent image; and a developer layer regulating member which regulates a layer thickness of developer on a circumferential surface of said developing roller, said developer layer regulating member having a first surface and a second surface along a longitudinal direction of said developer layer regulating member, to position said developer layer regulating member with respect to said developing frame, wherein a first imaginary plane, which is obtained by extending the first surface imaginarily, and a second imaginary plane, which is obtained by extending the second surface imaginarily, intersect each other, wherein a positioning portion in the first surface of the developer layer regulating member comprises a groove to effect positioning in a direction perpendicular to the longitudinal direction of the developer layer regulating member.

2. A developing device according to claim 1, wherein a positioning portion in the second surface of the developer layer regulating member comprises a groove to effect positioning in the longitudinal direction of the developer layer regulating member.

3. A developing device according to claim 1 or 2, wherein the groove in the first surface is opened in the longitudinal direction of the developer layer regulating member.

4. A developing device according to claim 2, wherein the groove in the second surface is opened in a direction perpendicular to the longitudinal direction of the developer layer regulating member.

5. A developing device according to claim 3, wherein a screw configured and positioned to fix said developer layer regulating member to said developing frame is extended through the groove in the first surface.

6. A developing device according to claim 1 or 2, wherein a screw configured and positioned to fix said developer layer regulating member to said developing frame is extended through the groove in the first surface.

7. A process cartridge detachably mountable to an image forming apparatus main body, the process cartridge comprising:

a developing frame;

an electrophotographic photosensitive member;

a developing roller configured and positioned to supply developer to an electrostatic latent image, which is formed on said electrophotographic photosensitive member, to develop the electrostatic latent image; and a developer layer regulating member which regulates a layer thickness of developer on a circumferential surface of said developing roller, said developer layer regulating member having a first surface and a second surface along a longitudinal direction of the developer layer regulating member, to position said developer layer regulating member with respect to said developing frame, wherein a first imaginary plane, which is obtained by extending the first surface imaginarily, and a second imaginary plane, which is obtained by extending the second surface imaginarily, intersect each other, wherein a positioning portion in the first surface of the developer layer regulating member comprises a groove to effect positioning in a direction perpendicular to the longitudinal direction of the developer layer regulating member.

8. A process cartridge according to claim 7, wherein a positioning portion in the second surface of the developer layer regulating member comprises a groove to effect positioning in the longitudinal direction of the developer layer regulating member.

9. A process cartridge according to claim 7 or 8, wherein the groove in the first surface is opened in the longitudinal direction of the developer layer regulating member.

10. A process cartridge according to claim 8, wherein the groove in the second surface is opened in a direction perpendicular to the longitudinal direction of the developer layer regulating member.

11. A process cartridge according to claim 9, wherein a screw configured and positioned to fix said developer layer regulating member to said developing frame is extended through the groove in the first surface.

12. A process cartridge according to claim 7 or 8, wherein a screw configured and positioned to fix said developer layer regulating member to said developing frame is extended through the groove in the first surface.

13. A developer layer regulating member used in a developing device that includes a developing frame and a developing roller configured and positioned to carry the developer to develop a latent image formed on an image bearing member, the developer layer regulating member regulating a layer thickness of developer on a circumferential surface of the developing roller, said developer layer regulating member comprising:

a first surface and a second surface along a longitudinal direction of the developer layer regulating member, to position the developer layer regulating member with respect to the developing frame, wherein a first imaginary plane, which is obtained by extending the first surface imaginarily, and a second imaginary plane, which is obtained by extending the second surface imaginarily, intersect each other, wherein a positioning portion in the first surface of the developer layer regulating member comprises a groove to effect positioning in a direction perpendicular to the longitudinal direction of the developer layer regulating member.

14. A developer layer regulating member according to claim 13, wherein a positioning portion in the second surface of the developer layer regulating member comprises a groove to effect positioning in the longitudinal direction of the developer layer regulating member.

15. A developer layer regulating member according to claim 13 or 14, wherein the groove in the first surface is opened in the longitudinal direction of the developer layer regulating member.

16. A developer layer regulating member according to claim 14, wherein the groove in the second surface is opened in a direction perpendicular to the longitudinal direction of the developer layer regulating member.

17. A developer layer regulating member according to claim 15, wherein a screw configured and positioned to fix said developer layer regulating member to the developing frame is extended through the groove in the first surface.

18. A developer layer regulating member according to any one of claims 13 or 16, wherein a screw configured and positioned to fix said developer layer regulating member to the developing frame is extended through the groove in the first surface.

19. A developer layer regulating member attaching method of attaching to a developing frame a developer layer regulating member which regulates the layer thickness of developer on a circumferential surface of a developing roller, the developer layer regulating member including: a first surface extending along a longitudinal direction of the developer layer regulating member and having a developer layer regulating portion configured and positioned to regulate the layer thickness; a second surface bent in a substantially perpendicular direction with respect to the first surface and extending along the longitudinal direction; and a groove portion provided in an end portion of the second surface on a side opposite to the first surface and opened in the substantially perpendicular direction, the developer layer regulating member attaching method comprising the steps of:

fitting in the groove portion a projecting portion provided in the developing frame for determining a position in the longitudinal direction of the developer layer regulating member with respect to the developing frame; and abutting, with the projecting portion being fitted in the groove portion, a position regulating portion provided in the developing frame against the first surface by moving the developer layer regulating member in the substantially perpendicular direction for determining a position in the substantially perpendicular direction of the developer layer regulating member with respect to the developing frame.

20. A developing device for developing a latent image formed on an image bearing member by using developer, the developing device comprising:

a developing frame;

a developing roller configured and positioned to supply developer to the latent image to develop the latent image; and a developer layer regulating member which regulates a layer thickness of developer on a circumferential surface of said developing roller, said developer layer regulating member having a first surface and a second surface along a longitudinal direction of said developer layer regulating member, to position said developer layer regulating member with respect to said developing frame, wherein a first imaginary plane, which is obtained by extending the first surface imaginarily, and a second imaginary plane, which is obtained by extending the second surface imaginarily, intersect each other, wherein a positioning portion in the second surface of the developer layer regulating member comprises a groove to effect positioning in the longitudinal direction of the developer layer regulating member.

21. A developing device according to claim 20, wherein the groove in the second surface is opened in a direction perpendicular to the longitudinal direction of said developer layer regulating member.

22. A developing device according to claim 20 or 21, wherein a positioning portion in the first surface of said developer layer regulating member comprises a groove.

23. A developing device according to claim 22, wherein a screw configured and positioned to fix said developer layer regulating member to said developing frame is extended through the groove in the first surface.

24. A process cartridge detachably mountable to an image forming apparatus main body, the process cartridge comprising:

a developing frame;

an electrophotographic photosensitive member;

a developing roller configured and positioned to supply developer to an electrostatic latent image, which is formed on said electrophotographic photosensitive member to develop the electrostatic latent image; and a developer layer regulating member which regulates a layer thickness of developer on a circumferential surface of said developing roller, said developer layer regulating member having a first surface and a second surface along a longitudinal direction of the developer layer regulating member, to position said developer layer regulating member with respect to said developing frame, wherein a first imaginary plane, which is obtained by extending the first surface imaginarily, and a second imaginary plane, which is obtained by extending the second surface imaginarily, intersect each other, wherein a positioning portion in the second surface of the developer layer regulating member comprises a groove to effect positioning in the longitudinal direction of the developer layer regulating member.

25. A process cartridge according to claim 24, wherein the groove in the second surface is opened in a direction perpendicular to the longitudinal direction of said developer layer regulating member.

26. A process cartridge according to claim 24 or 25, wherein a positioning portion in the first surface of said developer layer regulating member comprises a groove.

27. A process cartridge according to claim 26, wherein a screw configured and positioned to fix said developer layer regulating member to said developing frame is extended through the groove in the first surface.

28. A developer layer regulating member used in a developing device that includes a developing frame and a developing roller configured and positioned to carry the developer to develop a latent image formed on an image bearing member, the developer layer regulating member regulating a layer thickness of developer on a circumferential surface of the developing roller, said developer layer regulating member comprising:

a first surface and a second surface along a longitudinal direction of the developer layer regulating member, to position the developer layer regulating member with respect to the developing frame, wherein a first imaginary plane, which is obtained by extending the first surface imaginarily, and a second imaginary plane, which is obtained by extending the second surface imaginarily, intersect each other, wherein a positioning portion in the second surface of said developer layer regulating member comprises a groove to effect positioning in the longitudinal direction of the developer layer regulating member.

29. A developer layer regulating member according to claim 28, wherein the groove in the second surface is opened in a direction perpendicular to the longitudinal direction of the developer layer regulating member.

30. A developer layer regulating member according to claim 28 or 29, wherein a positioning portion in the first surface of said developer layer regulating member comprises a groove.

31. A developer layer regulating member according to claim 30, wherein a screw configured and positioned to fix said developer layer regulating member to the developing frame is extended through the groove in the first surface.

* * * * *

UNITED STATES PATENT AND TRADEMARK OFFICE

CERTIFICATE OF CORRECTION

PATENT NO. : 7,218,882 B2
APPLICATION NO. : 10/957610
DATED : May 15, 2007
INVENTOR(S) : Shinjiro Toba et al.

It is certified that error appears in the above-identified patent and that said Letters Patent is hereby corrected as shown below:

IN THE DRAWINGS, Sheet 12, FIGURE 13A
"EMBODIMENT" should read --EMBODIMENT 1--.

COLUMN 5
Line 50, "a-laser" should read --a laser--.

COLUMN 8
Line 26, "drum 10" should read --drum 1--.

COLUMN 9
Line 7, "opening 9" should read --opening 91--.

COLUMN 12
Line 30, "relationships Sa1≈Ba1" should read --relationships Sa1>Ba1--.
Line 33, "frame 45b." should read --frame 45a.--.
Line 61, "sleeve" should read --blade--.

COLUMN 13
Line 1, "portion 44a" should read --portion 44b--.

COLUMN 20
Line 24, "or 16," should read --or 14,--.

COLUMN 21
Line 32, "member" should read --member,--.

Signed and Sealed this

Third Day of February, 2009

John Doll

JOHN DOLL
*Acting Director of the United States Patent and Trademark Office*